US008631940B2

(12) United States Patent
Hay et al.

(10) Patent No.: US 8,631,940 B2
(45) Date of Patent: Jan. 21, 2014

(54) PLASTIC DUMPSTER

(75) Inventors: Henry F. Hay, Calgary (CA); Daniel Andrew Depenhart, Monaca, PA (US); Sean Barton, Didsbury (CA)

(73) Assignee: Nova Chemical (International). SA, Fribourg (CH)

( * ) Notice: Subject to any disclaimer, the term of this patent is extended or adjusted under 35 U.S.C. 154(b) by 354 days.

(21) Appl. No.: 12/807,487

(22) Filed: Sep. 7, 2010

(65) Prior Publication Data

US 2012/0055834 A1 Mar. 8, 2012

(51) Int. Cl.
*B65F 1/14* (2006.01)

(52) U.S. Cl.
USPC ..... 206/519; 206/518; 220/908; 294/68.2

(58) Field of Classification Search
USPC ..... 294/68.2, 68.26; 206/518, 519; 220/908, 675, 672, 669, 751, 694
See application file for complete search history.

(56) References Cited

U.S. PATENT DOCUMENTS

| | | | | |
|---|---|---|---|---|
| 3,669,485 | A | 6/1972 | Stihler | |
| 4,550,849 | A | 11/1985 | Adsit | |
| 4,798,081 | A | 1/1989 | Hazlitt et al. | |
| 5,089,321 | A | 2/1992 | Chum et al. | |
| 5,183,180 | A | 2/1993 | Hawkins et al. | |
| 5,330,071 | A | 7/1994 | Parker | |
| 7,237,689 | B2 | 7/2007 | Maggio, Sr. et al. | |
| 8,141,921 | B2 * | 3/2012 | Apps et al. | 294/68.2 |
| 2006/0045680 | A1 | 3/2006 | d'Arc et al. | |
| 2008/0197645 | A1 | 8/2008 | Hatamian et al. | |
| 2008/0237251 | A1 | 10/2008 | Barber | |
| 2009/0179444 | A1 | 7/2009 | Apps et al. | |
| 2010/0089259 | A1 * | 4/2010 | Hallman et al. | 100/188 R |

OTHER PUBLICATIONS

U.S. Appl. No. 12/657,834, filed Jan. 28, 2010, Hay et al.
L. Wild et al, Determination of Branching Distribution in Polyethyene and Ethylene Copolymes, Jr. Poly. Sci.: Poly. Phys. Ed., vol. 20, p. 441-455 (1982).

* cited by examiner

*Primary Examiner* — Stephen Castellano
(74) *Attorney, Agent, or Firm* — Kenneth H Johnson

(57) ABSTRACT

A unitary plastic container, which is optionally used for waste collection comprises a base, a front wall, a back wall and two opposing side walls, each wall extending upwardly from the base to define an open container top and an interior container volume. Each side wall has an outwardly extending sidewall portion which is outwardly offset relative to the rest of the container side wall. In each outwardly extending sidewall portion, an elongated cutout, indentation or channel is present. The elongated channel has a forward opening, a rearward opening and an elongated side opening extending from the forward opening to the rearward opening. The elongated channel lies within the interior container volume and divides the outwardly extending sidewall portion into two areas: an upper outwardly extending sidewall portion and a lower outwardly extending portion. The outwardly open elongate channel may be fitted with a reinforcing sleeve.

24 Claims, 23 Drawing Sheets

PLASTIC DUMPSTER

FIELD OF THE INVENTION

The present invention provides a simplified nestable plastic container with inwardly offset elongated side channels. The container may optionally be used as a waste container.

BACKGROUND OF THE INVENTION

Storage and waste containers are well known. The majority of such containers are made from steel. There are several disadvantages associated with the use of steel containers, chief among them being high weight and poor durability due to corrosion and rust. As such, several recent dumpster and container designs have instead employed plastic as the principle structural material. Thermoplastics are ideally suited to applications benefiting from decreased weight requirements and improved long term durability.

U.S. Pat. No. 3,669,485 provides an early example in which a dumpster is fabricated mainly from plastic. The dumpster has reinforced end walls to which two vertically spaced channel members are bolted, and which are designed to receive the tines of a forklift. The channel members define an elongated channel which is external of the container interior volume. Because the channel members are made of metal, they are subject to corrosion.

U.S. Pat. No. 4,550,849 discloses a refuse container made of thermoformable plastic and which is fabricated by rotational molding. The side walls of the container have upper and lower portions offset from one another and which are designed to receive a metal reinforcement sleeve in order to distribute loading stresses when the container is lifted by a pair of forklift tines. The metal sleeves are held within channeled areas which are entirely surrounded by plastic. There is no outwardly open elongate channel present. Hence, it would be difficult to replace the reinforcing sleeve if it should become necessary due to corrosion issues. Further, use of enclosed channel areas, generally requires that the container be molded with the metal sleeves already in place, a method which is not always desirable.

U.S. Pat. No. 5,183,180 describes a plastic refuse container in which each of the side walls and end walls has vertically oriented ribs to increase the structural rigidity of the container. The container includes metal lifting pockets which are bolted to the exterior of the container side walls. The refuse container can be fitted with lid structures. U.S. Pat. Appl. No. 2008/0237251 discloses a similar refuse container made of plastic. Flanged fork pockets made of a metal material are bolted to the exterior side walls and partially wrap around the front wall of the container. The container side walls have outwardly offset upper areas which overhang the fork pockets slightly to help distribute the weight of the container to the side walls when the container is lifted by the fork pockets.

U.S. Pat. No. 5,330,071 teaches a large plastic refuse container in which fork pockets are present within an outwardly extending channeled area in each of the container side walls. The channeled area is enclosed on upper, lower and exterior surfaces. There is no teaching of an outwardly open elongated channel which can receive a metal insert. Instead, a tubular metal insert is placed in the channeled area through an inwardly facing elongate opening. The design of the outwardly positioned fork pockets prevent these containers from being deeply nestable.

U.S. Pat. Appl. No. 2006/0045680 describes a rotomolded plastic container made from so called "vibration adsorbing material" such as linear low density polyethylene. The containers are fitted with a metal sleeve assembly which includes a fork pocket which is fixed to an exterior side wall surface.

U.S. Pat. Appl. No. 2009/0179444 discloses a plastic dumpster which has removable and externally placed plastic sleeve members which can receive a lift member. Alternatively, the outwardly extending plastic sleeves may be integrally molded with the rest of the container body. In each embodiment of the invention, the sleeves are tubular. The container may also have beveled corner areas. The container does not posses outwardly open elongated channels and does not provide interior storage space above the location of the sleeve members.

U.S. Pat. Appl. No. 2008/0197645 teaches a multi-modular waste container made of structural foam. The container has tiered interior and exterior surfaces and has detachably fastenable "arms" which engage each side wall. The arms define tubular areas which receive prongs or lift members. The tiered exterior and interior surfaces facilitate nesting of multiple containers, but such nesting requires removal of the attached arms.

U.S. Pat. No. 7,237,689 discloses a plastic waste container that is formed by rotational molding and which has integrally molded tine pockets. The plastic tine pockets have integrally molded struts which extend from the pocket along a side wall at positions above and below the pocket. The struts help to reinforce the tine pockets and distribute stresses to the walls when the container is lifted. The pockets extend outwardly from the container interior and can receive a metal or plastic insert to increase their overall strength. The pockets are fully surrounded by plastic walls and have no side opening. The pockets extend outwardly from the container interior, preventing the tight nesting of a plurality of such containers. There is also no interior storage space above the pocket areas.

Despite the above disclosures, there remains a need for new, improved containers, such as containers having greater strength around a tine pocket or channeled area and which permit facile exchange of vulnerable reinforcing elements such as tine pocket metal sleeves or inserts. Also desirable would be a deeply nestable container which does not require removal of external pockets or lift members prior to nesting. Finally, a container which combines interior storage space above a channel or tine pocket area, with greater strength and nestability features would be beneficial.

SUMMARY OF THE INVENTION

The present invention provides a unitary plastic container in which outwardly open elongate channels, which may be engaged by a lift member, occupy some of the interior container volume so as to improve the channel strength and to allow facile stacking of a plurality of containers.

The present invention provides a container in which interior storage space is present above channels which may be engaged by a lift member.

The present container design allows for deep container nesting or tight container stacking which minimizes storage requirements when not in use.

The present invention provides a unitary plastic container in which outwardly open elongate channels, which may be engaged by a lift member pair, are located within the container interior volume so as to improve the strength of the elongate channels.

The present invention provides a plastic container which is unitary and nestable without requiring removal of external pockets or arms.

The present invention provides a plastic container having outwardly open elongate channels which allow facile addition and removal of reinforcing sleeves.

The present invention provides a plastic container having outwardly open elongate channels which allow for the addition of reinforcing sleeves to each channel after the container body has been fabricated.

Provided is a container comprising: a plastic container body comprising a container base, a container front wall, a container back wall, and two opposing container side walls, where each container wall extends upwardly from the container base to define an open container top and an interior container volume, and where each container side wall has an outwardly extending sidewall portion comprising an elongated channel having a forward opening, a rearward opening and an elongated side opening extending along the outwardly extending sidewall portion from the forward opening to the rearward opening. Optionally, an open ended elongated sleeve may be fixed within an elongated channel in each of the container side walls.

Provided is a container comprising: a) a plastic container body comprising a container base, a container front wall, a container back wall, and two opposing container side walls, where each container wall extends upwardly from the container base to define an open container top and an interior container volume, and where each container side wall has an outwardly extending sidewall portion comprising an elongated channel having a forward opening, a rearward opening and an elongated side opening extending along the outwardly extending sidewall portion from the forward opening to the rearward opening, so that the elongated channel resides within the interior container volume; and b) a pair of open ended elongated sleeves, each sleeve fixed within a corresponding elongated channel in each of the container side walls.

Provided is a container comprising: a plastic container body comprising a container base, a container front wall, a container back wall, and two opposing container side walls, each container wall extending upwardly from the container base to define an open container top and an interior container volume, wherein each container side wall comprises: an upper outwardly extending sidewall portion, a lower outwardly extending sidewall portion, an upper recessed sidewall portion residing between the upper and lower outwardly extending sidewall portions, and a lower recessed sidewall portion residing below the lower outwardly extending sidewall portion; the upper outwardly extending sidewall portion, the lower outwardly extending sidewall portion and the upper recessed sidewall portion together defining there-between an elongated channel having a forward opening along the container front wall, a rearward opening along the container back wall and an elongated side opening extending from the forward opening to the rearward opening.

In an embodiment of the invention, a pair of open ended elongated sleeves are fixed within corresponding elongated channels, one in each of the container side walls.

Provided is a container comprising: a) a plastic container body comprising a container base, a container front wall, a container back wall, and two opposing container side walls, each container wall extending upwardly from the container base to define an open container top and an interior container volume, wherein each container side wall comprises: an upper outwardly extending sidewall portion, a lower outwardly extending sidewall portion, an upper recessed sidewall portion residing between the upper and lower outwardly extending sidewall portions, and a lower recessed sidewall portion residing below the lower outwardly extending sidewall portion; the upper outwardly extending sidewall portion, the lower outwardly extending sidewall portion and the upper recessed sidewall portion together defining there-between an elongated channel having a forward opening along the container front wall, a rearward opening along the container back wall and an elongated side opening extending from the forward opening to the rearward opening; and b) a pair of open ended elongated sleeves, each sleeve fixed within a corresponding elongated channel in each of the container side walls.

In an embodiment of the invention, the container comprises a pair of open ended elongated sleeves which are tubular.

In an embodiment of the invention, the container comprises a pair of open ended elongated sleeves which are fabricated from a material selected from the group consisting of metals, thermoset plastic materials, and thermoplastic materials.

In an embodiment of the invention, the container comprises a pair of open ended elongated sleeves fabricated from at least one metal.

In an embodiment of the invention, the container has a back wall with a larger vertical dimension than a front wall so that each of the container side walls has an upper edge which angles upwardly from the front wall to the back wall.

In an embodiment of the invention, the container side walls each comprise an upper outwardly extending sidewall portion having an outward extending distance relative to a lower recessed sidewall portion, and a lower outwardly extending sidewall portion having an outward extending distance relative to the lower recessed sidewall portion, where the outward extending distance of the upper outwardly extending sidewall portion and the outward extending distance of the lower outwardly extending sidewall portion is substantially equivalent.

In an embodiment of the invention, the container comprises a lid.

In an embodiment of the invention, a lower outwardly extending sidewall portion in each container side wall comprises a plurality of vertical grooves that are laterally spaced relative to one another.

In an embodiment of the invention, a plurality of vertical grooves divide lower outwardly extending container sidewall portions into a plurality of outwardly extending islands which are laterally spaced relative to one another.

In an embodiment of the invention, at least one reinforcement rib is present in at least one of the container base, front wall, back wall, or side walls.

In an embodiment of the invention, the container body is fabricated from a plastic material selected from the group consisting of thermoset plastic materials, thermoplastic materials and combinations thereof.

In an embodiment of the invention, a lower portion of the container front wall is outwardly leaning and the container back wall is outwardly leaning to facilitate the nesting of a plurality of containers.

In an embodiment of the invention, at least of potion of each container side wall is outwardly leaning to facilitate the nesting of a plurality of containers.

In an embodiment of the invention, the container comprises upper outwardly extending sidewall portions each comprising an upper shelf surface residing within the container interior.

In an embodiment of the invention, the container comprises lower outwardly extending sidewall portions each comprising a lower shoulder surface.

In an embodiment of the invention, an upper shelf surface of each upper outwardly extending container sidewall portion and a lower shoulder surface of each lower outwardly extending container sidewall portion are complementary surfaces so that the upper shelf surfaces of a lower one of the containers can abut against the lower shoulder surfaces of an upper one of the containers, thereby facilitating the nesting and stacking of a plurality of the containers. In another embodiment of the invention, at least a portion of the upper shelf surfaces and at least a portion of the lower shoulder surfaces are complementary contoured surfaces so that the contoured surface of the upper shelves of a lower one of said containers can engage the contoured surface on the lower shoulders of an upper one of the containers, thereby facilitating the nesting and stacking of a plurality of the containers.

In another embodiment of the invention, in each container side wall an upper shelf surface has a plurality of knobs which are complementary to vertical grooves in a lower outwardly extending sidewall portion so that the knobs on the upper shelves of a lower one of the containers can engage the grooves in the lower outwardly extending sidewall portions of an upper one of the containers, thereby facilitating the nesting and stacking of a plurality of the containers.

Provided is a nested container stack comprising a plurality of containers where the base of an upper container is received through the open top of a lower container so that a portion of the upper container is received within the interior volume of the lower container and where a lower shoulder surface in each lower outwardly extending sidewall portion of the upper container abuts a corresponding upper shelf surface in each upper outwardly extending sidewall portion of the lower container.

Containers which comprise various combinations of one or more of the various features described above are also part of the present invention.

DETAILED DESCRIPTION

The present invention provides a container, which is optionally used as a waste container. The container comprises a container body which is preferably plastic and optionally a pair of reinforcement sleeves. In the present invention, the terms "plastic container body" or "container body" generally encompass all portions of the container except for optional reinforcement sleeves and, if present, an optional lid.

Figure 1:
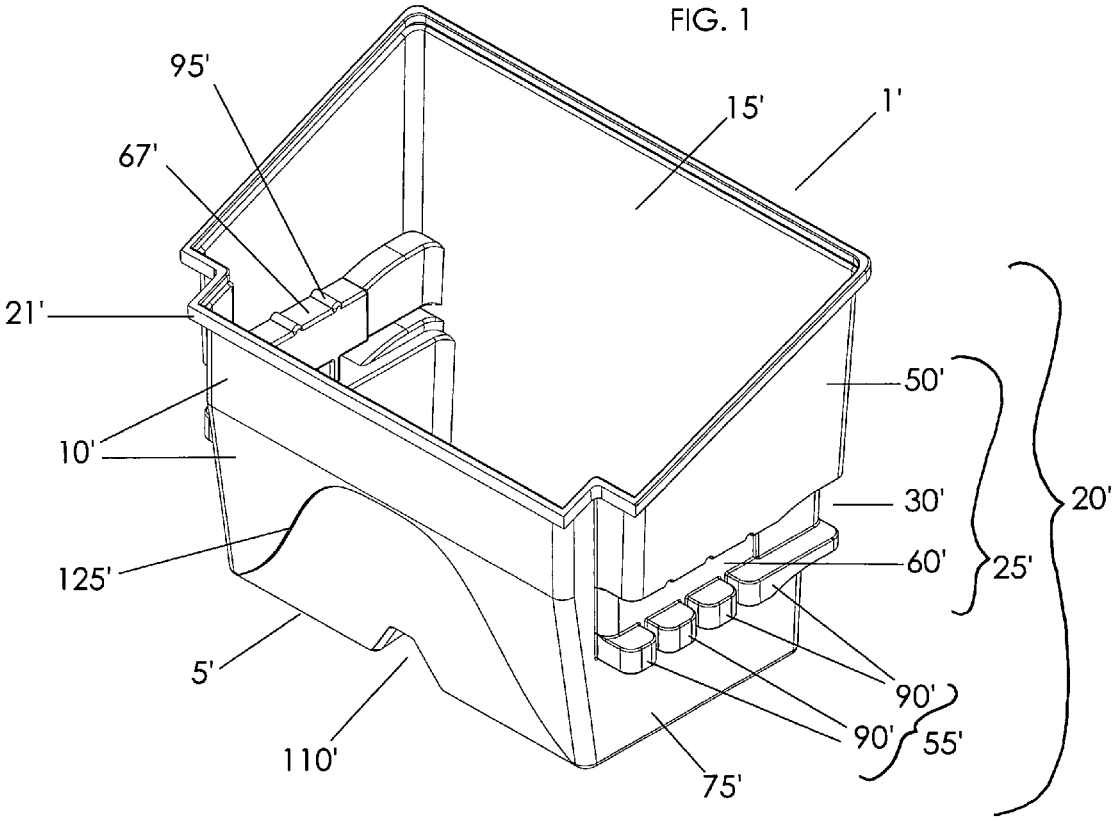
FIG. 1 shows a perspective view of an embodiment of the invention.
Figure 2:
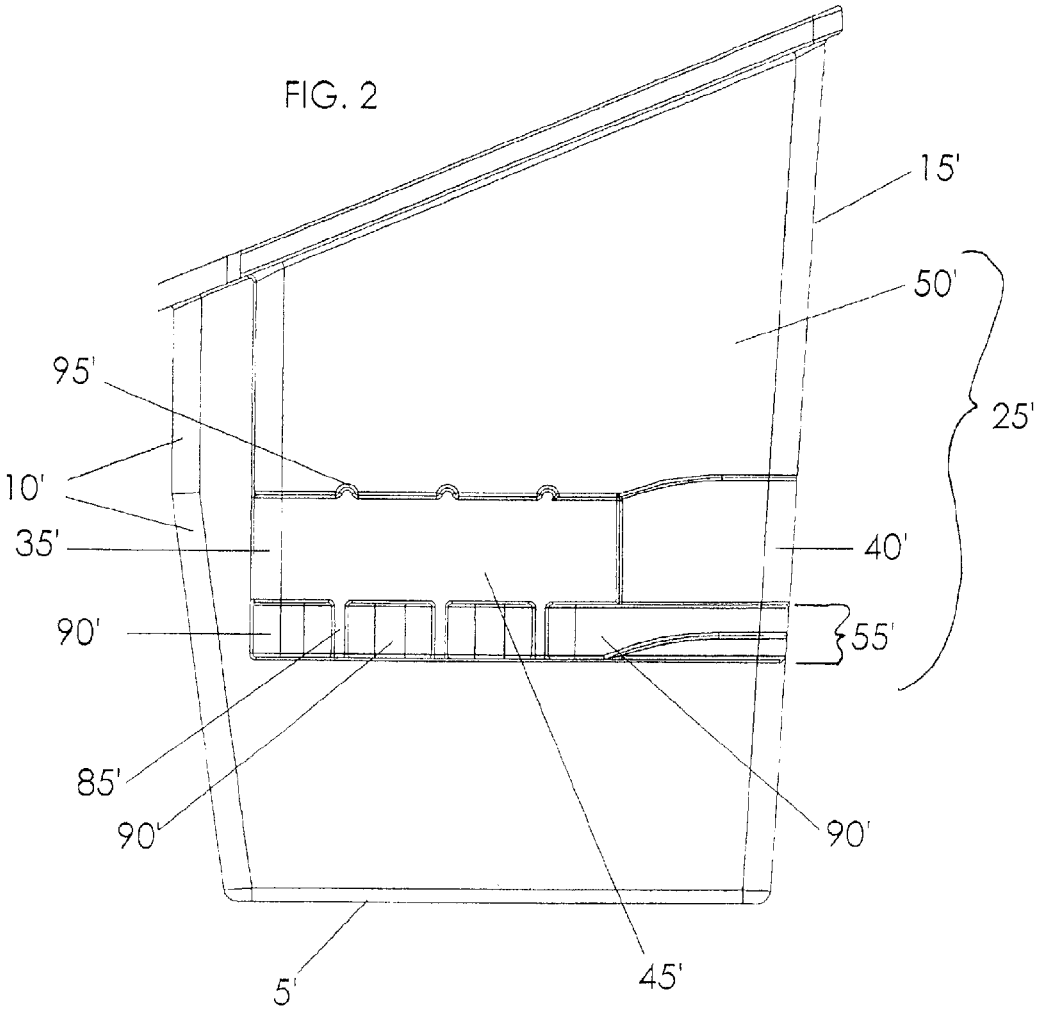
FIG. 2 shows a side view of an embodiment of the invention.
Figure 3:
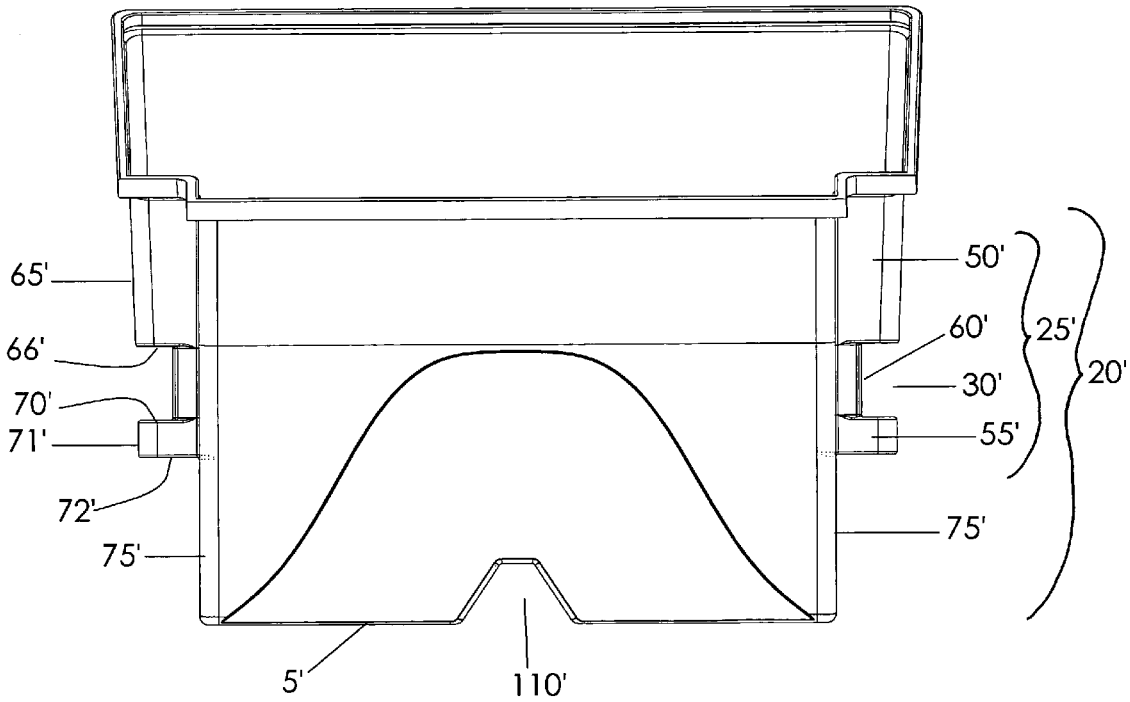
FIG. 3 shows a front view of an embodiment of the invention.

With reference to FIGS. 1, 2 and 3, the container 1' has a container body comprising a container base 5', a container front wall 10', a container back wall 15', and two opposing container side walls 20'. Each of the container front, back and side walls extend upwardly from the container base to define an open container top and an interior container volume. In particular, each container side wall has an outwardly extending sidewall portion 25' which is outwardly offset relative to the rest of the container side wall. The outwardly extending sidewall portion may be flush with the front and/or back wall of the container or it may be inwardly offset relative to the front and/or back wall (with reference to FIGS. 1-3, the outwardly extending sidewall portion 25' is inwardly offset relative to the container front wall and flush with the container back wall). In each outwardly extending sidewall portion, an elongated cutout, indentation or channel 30' is present. The elongated channels have a forward opening 35', a rearward opening 40' and an elongated (outwardly open) side opening 45' extending along said outwardly extending side wall portion from the forward opening to the rearward opening (see FIGS. 1-3). The elongated channel can be considered to lie within the interior container volume and divides the outwardly extending sidewall portion 25' into two areas: an upper outwardly extending sidewall portion 50' and a lower outwardly extending portion 55', which are spaced apart vertically by an upper sidewall portion 60' defining the inner wall of the elongated channel (and which is inwardly offset relative to the upper and lower outwardly extending sidewall portions 50' and 55' respectively). The upper outwardly extending side wall portion is upwardly open and forms at least part of the upper perimeter edge of the side wall proper. The upper outwardly extending sidewall portion has an outer wall 65' and an upper overhanging shoulder wall 66' which defines the upper wall of the elongated channel member. The upper overhanging shoulder wall simultaneously defines an upper shelf surface 67' residing within the container interior. The lower outwardly extending sidewall portion has an upper wall 70' which defines the lower wall of the elongated channel member, an outer wall 71' and a lower overhanging shoulder wall 72'. The lower overhanging shoulder wall may be flush with, but is preferably upwardly offset from the container base. When the lower overhanging shoulder wall is upwardly offset from the container base, the container side wall will have a lower sidewall region 75' residing below the lower overhanging shoulder wall (and which is inwardly offset relative to the upper and lower outwardly extending sidewall portions 50' and 55' respectively). In a preferred embodiment of the invention, the elongated channel in each container side wall will contain a reinforcing sleeve 80' (not shown in FIGS. 1-3).

The container may have minor modifications and changes which would be obvious to a person skilled in the art, all of which are within and consistent with the scope of the present invention.

Further elements and details of container 1' can include those features described below with reference to container 1.

Figure 4:
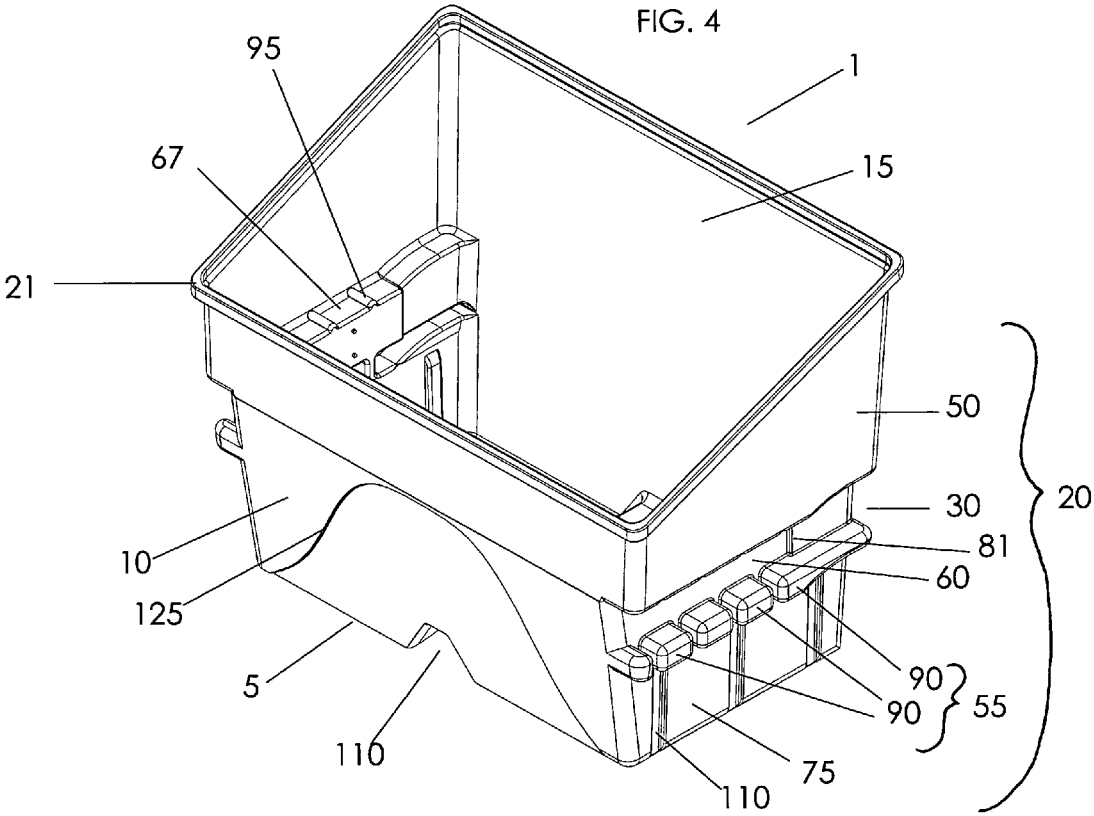
FIG. 4 shows a perspective view of an embodiment of the invention.

With reference to FIG. 4, the container 1 has a container body comprising a container base 5, a container front wall 10, a container back wall 15 and two opposing container side walls 20. The container front wall, back wall and two side walls (10, 15 and 20) extend upwardly from the peripheral edges of the container base 5 to define an open container top and an interior container volume.

The upper perimeter edge formed by the container front, back and side walls may have a flanged perimeter rim, or a lipped perimeter rim which is optionally enclosed. Alternatively, the upper perimeter edge formed by the container front, back and side walls may be un-rimmed. In an embodiment of the invention, the upper perimeter edge is an enclosed perimeter rim 21 (also see 21' in FIG. 1) which is optionally fully closed or vented by a continuous vent or one or more vent openings.

The container base, front, back and side walls are independently single or double walled and they may be formed using any suitable molding techniques well known to persons skilled in the art. In an embodiment of the invention, the container has a unitary container body manufactured using a rotomolding process. In an embodiment of the invention, the container front, back and side walls are of single wall construction, except for the rim structure which may optionally be double walled. In an embodiment of the invention, the container base is of double walled construction and the container front, back and side walls are of single wall construction, except for the rim structure which may optionally be double walled.

The container side walls have an outwardly extending sidewall portion comprising an elongated channel having a forward opening, a rearward opening and an elongated (outwardly open) side opening extending from said forward opening to said rearward opening and along the side wall.

Figure 5A:
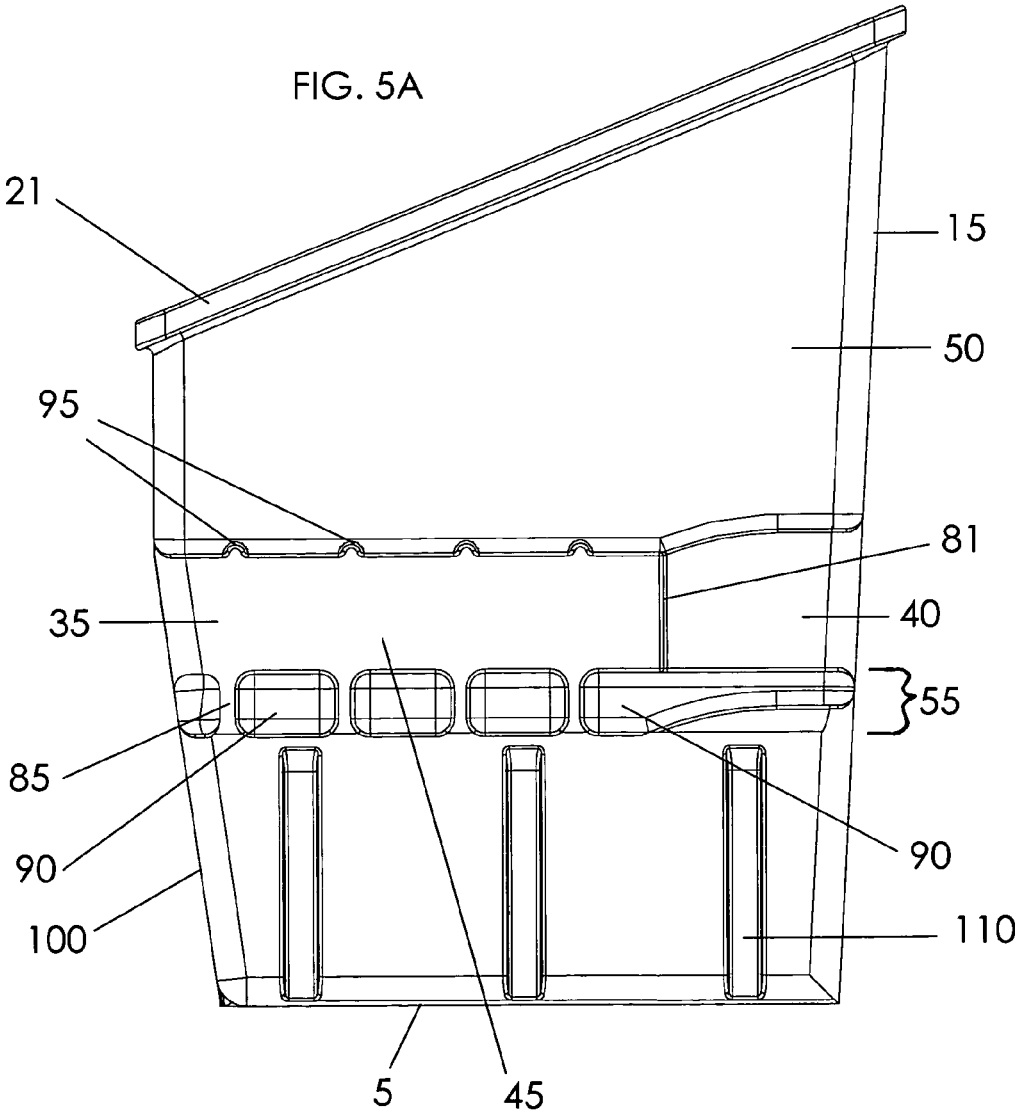
FIG. 5A shows a side view of an embodiment of the invention.
Figure 6A:
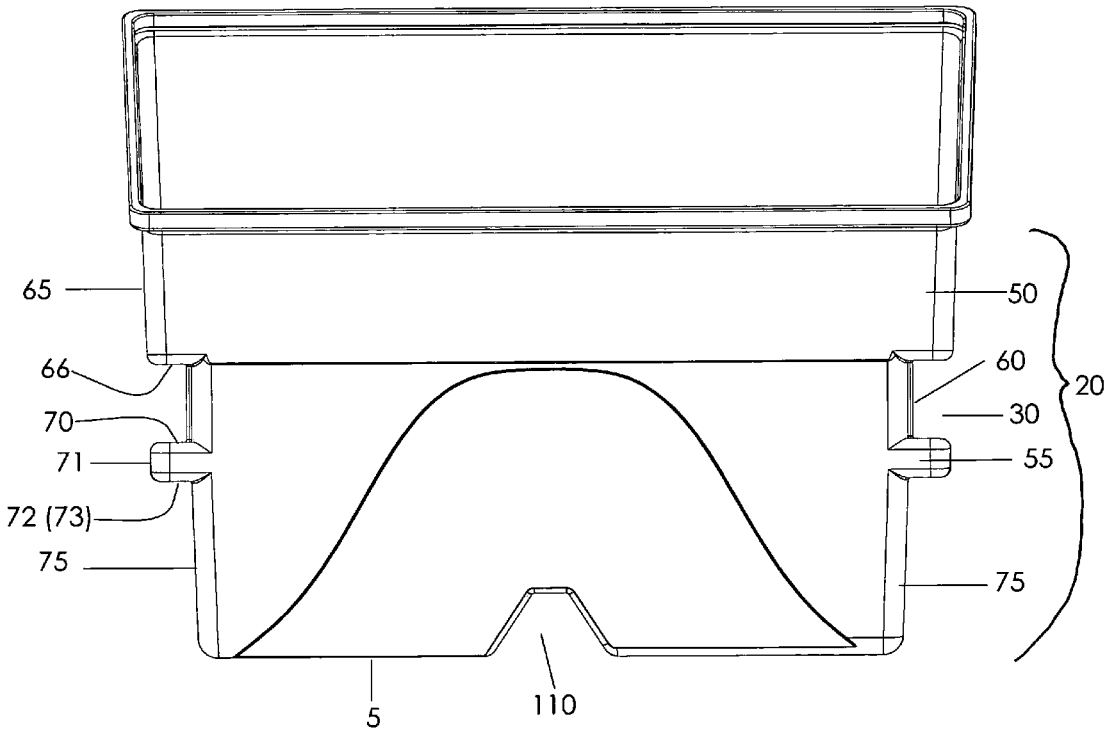
FIG. 6A shows a front view of an embodiment of the invention.

With reference to FIGS. 4, 5A and 6A, each container side wall has an upper outwardly extending sidewall portion 50, a lower outwardly extending side wall portion 55, an upper recessed side wall portion 60 which resides between said upper and lower outwardly extending side wall portions, and a lower recessed sidewall portion 75 which resides below the lower outwardly extending side wall portion. The upper recessed sidewall portion 60 is recessed relative to both of the upper and lower outwardly extending sidewall portions. The lower recessed sidewall portion 75 is recessed relative to both the upper 50 and lower 55 outwardly extending sidewall portions. The upper and lower outwardly extending side wall portions 50 and 55 are vertically spaced from one another by the upper recessed side wall portion 60. Together with the upper recessed sidewall portion, the upper and lower outwardly extending sidewall portions define there-between an outwardly open, elongate channel 30. The channel 30 may be considered to lie within the container interior volume otherwise defined by the front, back and side walls. In a preferred embodiment, an elongate channel 30 spans the entire width of each container side wall 20 so as to present laterally spaced forward 35 and rearward 40 openings in each of the container front wall 10 and back wall 15 respectively. The laterally spaced openings are present at the laterally spaced edges of the container front and back walls. The elongated channel 30 has an (outwardly open) side opening 45 which spans from forward opening 35 to rearward opening 40. The upper outwardly extending side wall portion is upwardly open and forms the upper perimeter edge of the container side wall proper. The upper outwardly extending side wall portion has an outer wall 65 and an upper overhanging shoulder wall 66. The upper overhanging shoulder wall defines the upper wall of the elongate channel. The upper overhanging shoulder wall also simultaneously defines an upper shelf surface 67 which resides within the container interior. The lower outwardly extending sidewall portion has an upper wall 70 which defines the lower wall of the elongated channel, an outer wall 71 and a lower overhanging shoulder wall 72. The lower overhanging shoulder wall 72 defines a lower shoulder surface 73, which resides outside of the container interior and which is immediately above the lower recessed side wall portion 75.

In an embodiment of the invention, in each container side wall, the upper outwardly extending sidewall portion has a larger vertical dimension (i.e. the height of outer wall 65 of the upper outwardly extending sidewall portion) than the lower outwardly extending sidewall portion (i.e. the height of the outer wall 71 of the lower outwardly extending sidewall portion) which is further shown in FIGS. 5A and 6A. In an embodiment of the invention, the upper outwardly extending sidewall portion has a smaller vertical dimension than the lower outwardly extending sidewall portion. In an embodiment of the invention, the upper outwardly extending sidewall portion and the lower outwardly extending sidewall portion have substantially the same vertical dimension.

Figure 5B:
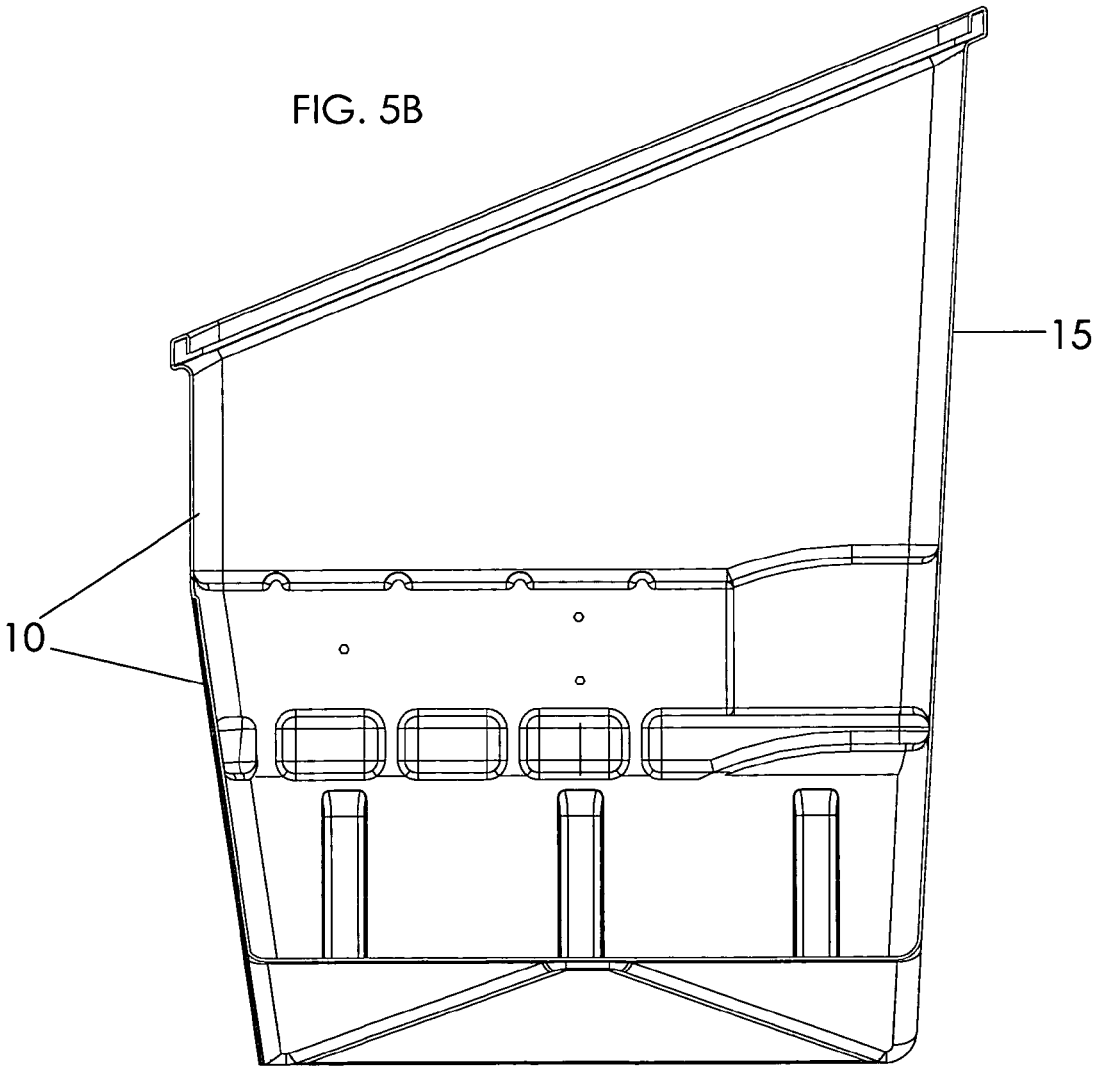
FIG. 5B shows a side cross-sectional view taken along a line bisecting the front and back wall of a container in an embodiment of the invention.

The container front, back, and side walls can all be of uniform height or they may be of different height. With reference to FIG. 5A (and FIG. 5B) the height of the back wall is greater than the height of the front wall. As a consequence, the upper edge of each side wall angles upwardly from the front wall to the back wall of the container. Similarly, the upper edge of each upper outwardly extending sidewall portion may have an upper edge which angles upwardly from the front wall to the back wall of the container.

The lower recessed sidewall portion 75 may be substantially flush or even with the upper recessed sidewall portion 60 or it may be inwardly offset relative to the upper recessed sidewall portion. It may be preferable for the lower recessed sidewall portion to be inwardly offset relative to the upper recessed sidewall portion to facilitate the nesting of a plurality of containers.

With reference to FIGS. 1 and 4, the container body may optionally have rounded or beveled corners or edges. Similarly, the forward and rearward openings of the elongated channel may be defined by straight lines or have rounded or beveled edges. Indeed, any corner or edge portion of the container (or any area or portion where at least two walls or at least two wall portions or at least two wall areas and the like come together) may be defined by straight lines or may be rounded or beveled. The rim structure may also be rounded or defined by straight lines. Without wishing to be bound by theory the use of rounded or beveled edges increases the resistance of the container to warping or deformation stresses and the like, or to provide resiliency against warping or deformation stress and the like.

In an embodiment of the invention the container will be nestable in another one of the containers. By the terms "nestable" or "nested" it is meant that the base of an upper one of the containers will fit within the open top of another lower one of the containers so that a portion of the upper container is received within the interior volume of the lower container. Nestable containers can comprise two of more containers and may form a nested container stack.

Figure 10:
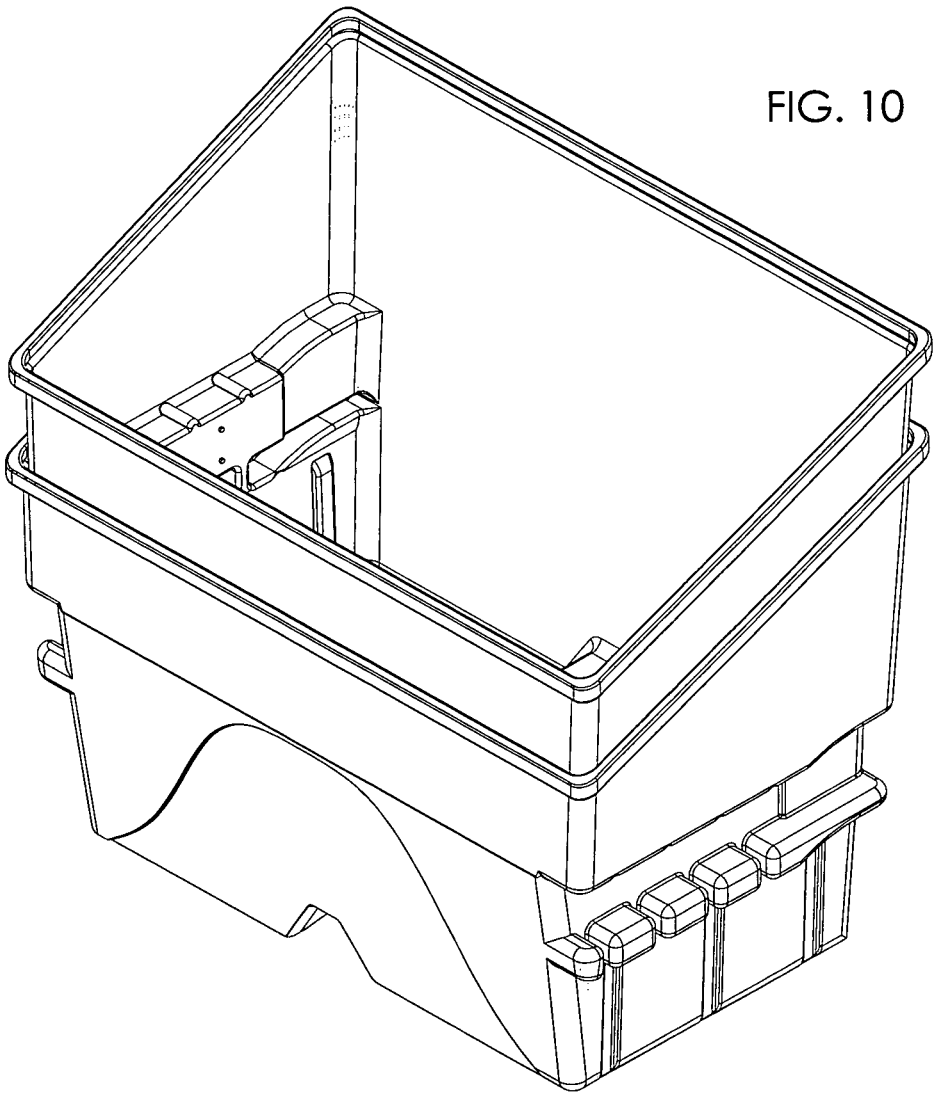
FIG. 10 shows a perspective view of nested containers of an embodiment of the invention.

In an embodiment of the invention, and with reference to FIG. 10, the container base, the lower outwardly extending sidewall portions, at least part of the elongated channels (optionally with reinforcing sleeves present as further described below), at least part of the upper outwardly extending sidewall portions, at least a part of the upper recessed sidewall portions, the lower recessed side wall portions, at least part of the container front wall, and at least part of the container back wall of an upper one of the containers will fit within the interior volume of another lower one of the containers.

In an embodiment of the invention, the container base, at least a portion of the lower outwardly extending sidewall portions, at least part of the elongated channels (optionally with reinforcing sleeves present as further described below), at least a part of the upper recessed sidewall portions, the lower recessed side wall portions, at least part of the container front wall, and at least part of the container back wall of an upper one of the containers will fit within the interior volume of another lower one of the containers.

Figure 6B:
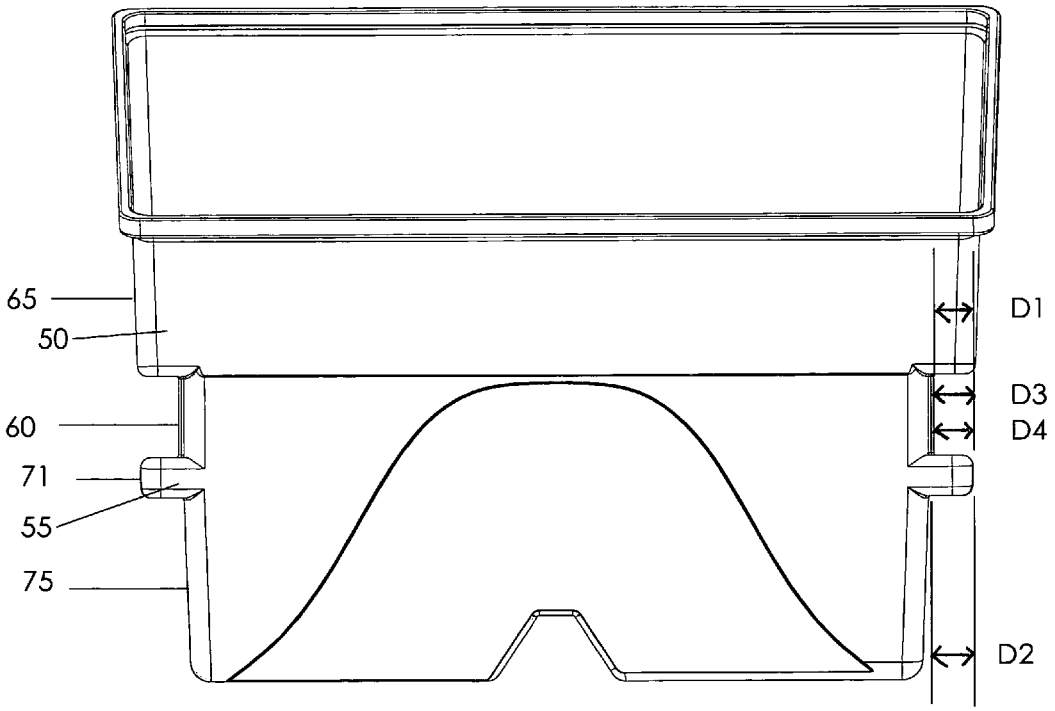
FIG. 6B shows distances D1, D2, D3 and D4 on a front view of an embodiment of the invention.

As shown in FIGS. 6A and 6B, the upper outwardly extending sidewall portion 50 has an outward extending distance D1 relative to the lower recessed sidewall portion 75, and the lower outwardly extending sidewall portion 55 has an outward extending distance D2 relative to the lower recessed sidewall portion 75. The distances D1 and D2, essentially define the offset distance between the lower recessed sidewall portion and the upper and lower outwardly extending sidewall portions respectively. For nestable containers it is preferable that the distance D1 and the distance D2 are substantially the same or that the distance D1 is greater than the distance D2.

As shown in FIGS. 6A and 6B, the upper outwardly extending sidewall portion 50 has an outward extending distance D3 relative to the upper recessed sidewall portion 60, and the lower outwardly extending sidewall portion 55 has an outward extending distance D4 relative to the upper recessed sidewall portion 60. The distances D3 and D4 essentially define the depth of the elongated channel with respect to the upper and lower outwardly extending sidewall portions respectively. Preferably, the distances D3 and D4 are substantially the same so that the elongated channel will have a uniform depth.

In an embodiment of the invention, the distances D1, D2, D3 and D4 are substantially the same. In another embodiment, the distances D1 and D2 are substantially the same and larger than the distances D3 and D4 which are substantially the same.

The elongate channel may have any shape suitable for receiving a lifting member. In one embodiment and with reference to FIGS. 4 and 6A, the elongate channel has an approximately U-shaped cross section. The elongated channel has an upper channel wall defined by the upper overhanging shoulder wall 66 of the upper outwardly extending sidewall portion 50, a lower channel wall defined by the upper wall 70 of the lower outwardly extending side wall portion 55 and an inner channel wall defined by upper recessed sidewall portion 60.

The elongated channel 30 (or 30') may be fashioned to receive any suitable lift member. Any suitable apparatus, equipment or machine having one or more or preferably two lift members is contemplated for use with the current invention, provided that the lift members can be made to engage each elongated channel, preferably in a simultaneous fashion. Alternatively, the container can be fabricated so as to have elongated channel members separated by a standard distance suitable for use with standard lift member equipment. Lift members may by way of non-limiting example be selected from the group consisting of lift forks, lift straps and combinations thereof.

Figure 11A:
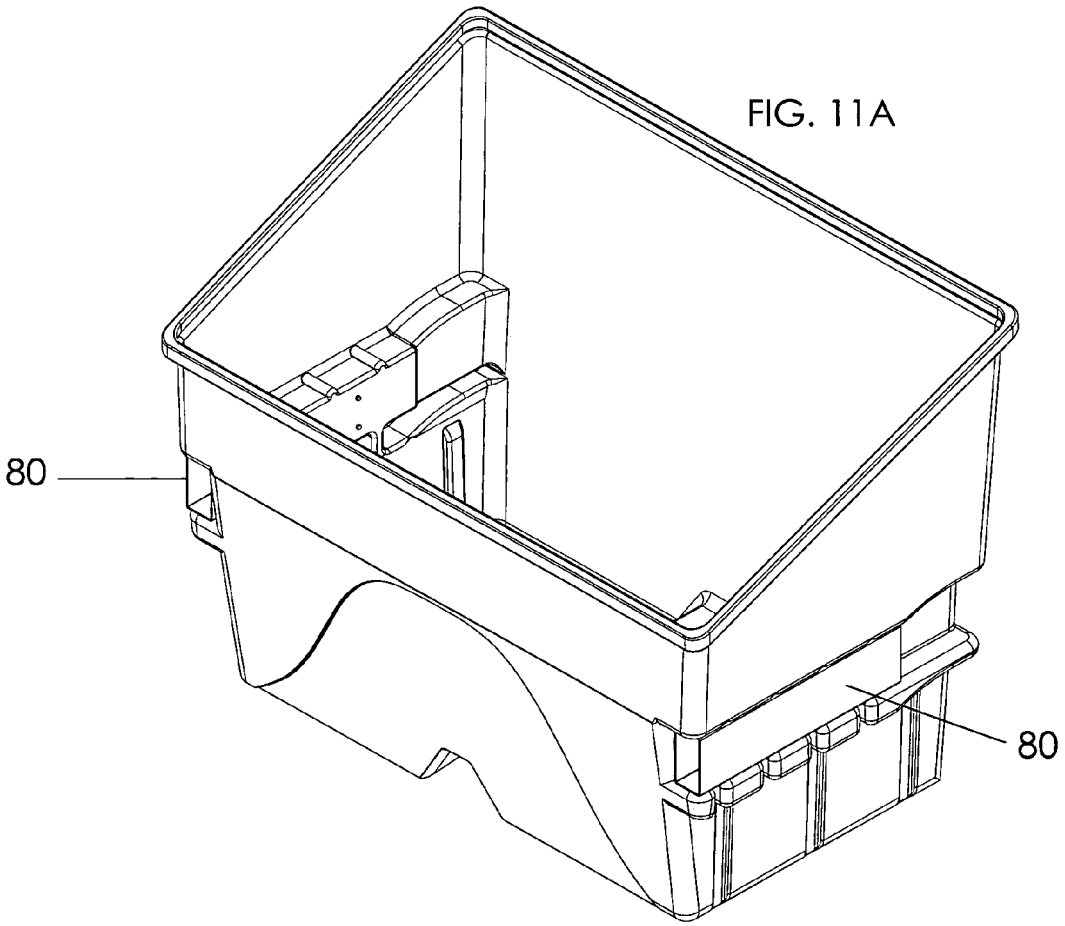
FIG. 11A shows a perspective view of an embodiment of the invention.
Figure 11B:
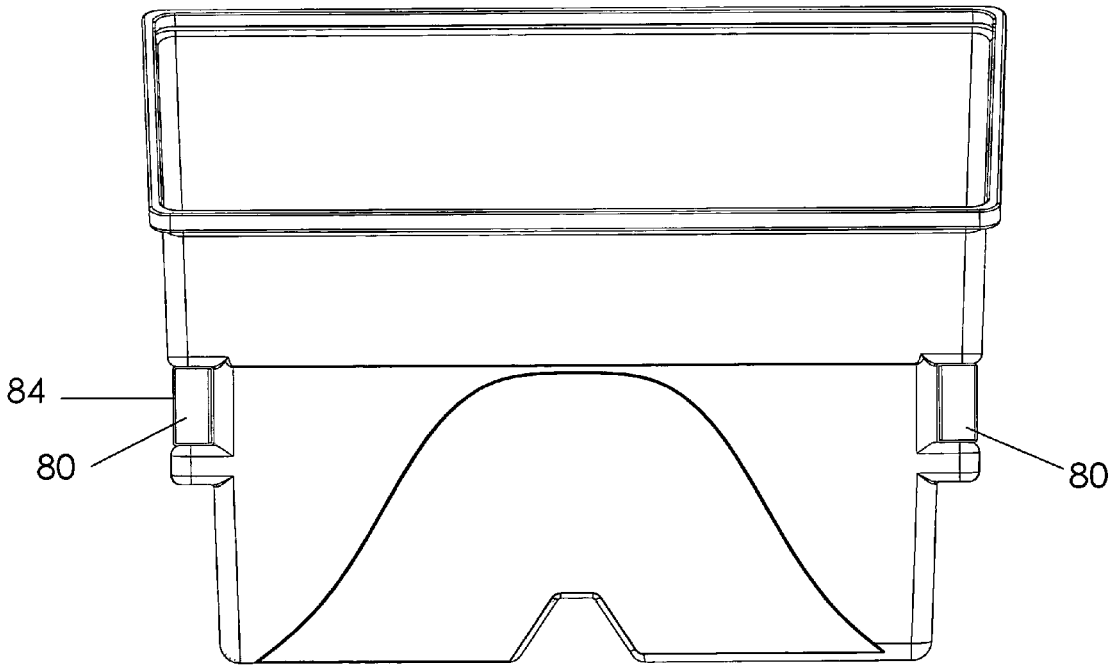
FIG. 11B shows a front view of an embodiment of the invention.
Figure 11C:
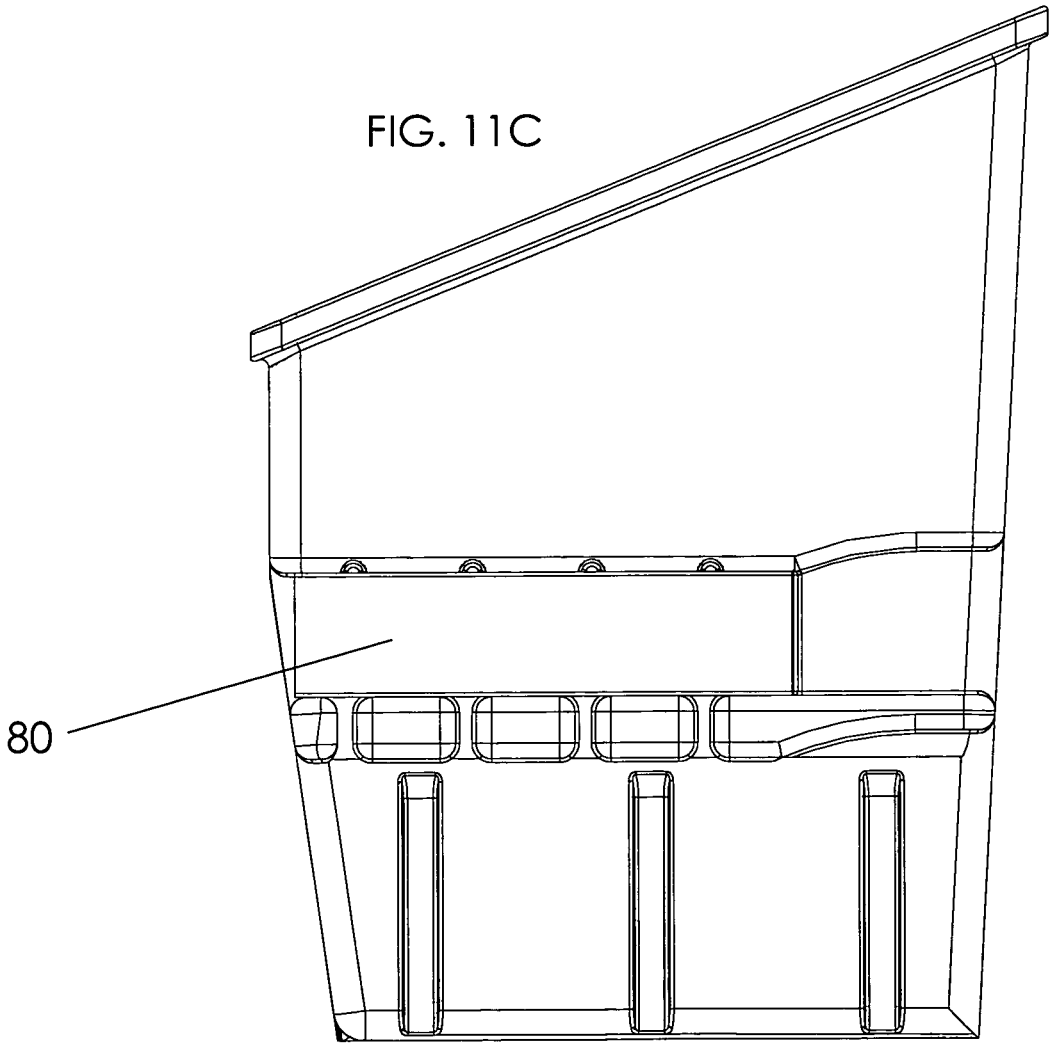
FIG. 11C shows a side view of an embodiment of the invention.

In an embodiment of the invention, an open ended elongated sleeve 80 is fixed within the elongated channel of each container side wall (see FIGS. 11A, 11B and 11C). The term "fixed" is used to mean "held in place" and includes fixing means which may be considered reversible or largely irreversible. Without wishing to be bound by theory, the sleeve will reinforce the elongated channel walls against stresses associated with lifting the container via the elongated channels.

Figure 12A:
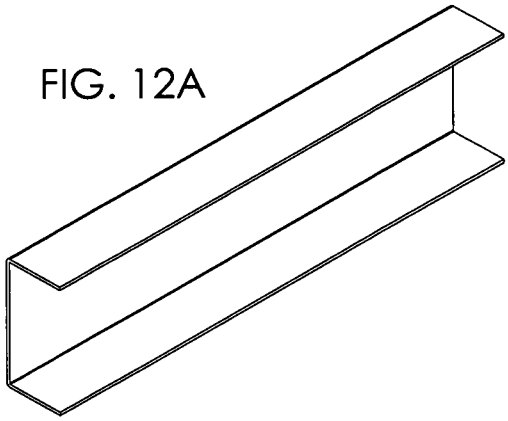
FIG. 12A shows a perspective view of a sleeve of an embodiment of the invention.
Figure 12B:
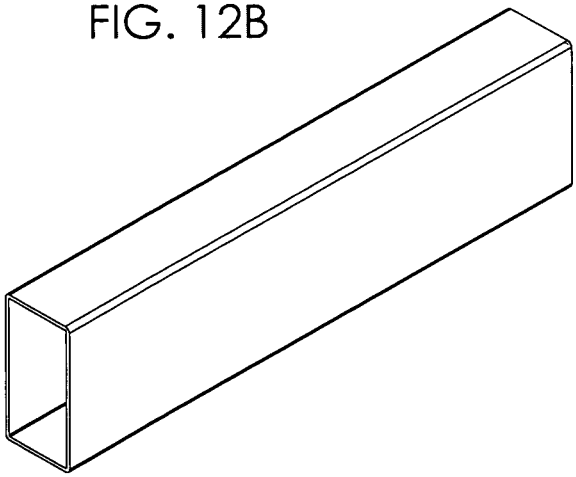
FIG. 12B shows a perspective view of a sleeve of an embodiment of the invention.

The elongated sleeve can take any suitable shape which can accommodate a lift member. For example the sleeve can be an elongated semi-tubular member having an approximately U-shaped cross section (see FIG. 12A). Alternatively, the sleeve can be an elongated fully tubular member having a substantially square or rectangular cross section (see FIGS. 11A, 11B and 12B). Any sleeve (e.g. tubular or semi tubular members) can be used in the present invention, provided that the sleeve has at least a forward opening to allow entry of a lift member.

In an embodiment of the invention, the sleeve has a forward opening to allow entry of a lift member. In another embodiment of the invention, the sleeve has both a forward and a rearward opening to allow entry of a lift member.

The sleeve 80 may be as long as, longer than, or shorter than a corresponding elongated channel in which it is placed. In an embodiment of the invention, and with reference to FIGS. 11A and 11C, the sleeve is shorter than the elongated channel. In another embodiment, the sleeve is substantially the same length as the elongated channel.

For container nesting purposes, it is preferable that the sleeve is substantially the same length or shorter than the elongated channel. If the sleeve is shorter than the elongated channel, then the upper recessed sidewall portion 60 (or 60') may additional comprise a stop against which the sleeve abuts (i.e. so that the sleeve is not positioned beyond the stop member in the elongated channel). With reference to FIGS. 4 and 5A the stop member 81 may take the form of a small step formed in the upper recessed sidewall portion (i.e. the inner channel wall 60) which abuts against a rearward end of a sleeve, when the sleeve is fitted within an elongated channel.

The sleeve 80 may be fabricated from metal, thermoplastic materials and thermoset plastic materials. In an embodiment of the invention, the sleeve is fabricated from at least one metal.

The sleeve 80 may be fixed within an elongated channel before or after fabrication of the container body. For example, the sleeves may be fixed within corresponding elongated channels during a rotomolding process by adding sleeves to a mold used for the formation of the container body. In an embodiment, the sleeves are added after the plastic container has been fabricated.

The sleeve may be fixed within an elongated channel using any of the methods known to persons skilled in the art, such as bolting, using adhesive or simple friction fit methods. In an embodiment, the sleeve is reversibly fixed to an elongate channel by a friction fit. As already discussed above a sleeve may also be incorporated into an elongated channel during container fabrication. It may also be desirable to mold in features to the elongated channel surfaces which make it possible to "snap fit" sleeves into place. For example, a plurality of projections having a wedge or arcuate shape may be used on the channel surfaces, so that the sleeves encounter increasing resistance as they are forced into place and then "snap" into a secure position In an embodiment of the invention, the (elongated) sleeve 80 has an outer edge 84 which is substantially flush with said upper outwardly extending sidewall portion.

In an embodiment of the invention, the (elongated) sleeve 80 has an outer edge 84 which is substantially flush with said lower outwardly extending sidewall portion.

In an embodiment of the invention, and with reference to FIG. 11B, the (elongated) sleeve 80 has an outer edge 84 which is substantially flush with both the upper and lower outwardly extending sidewall portions. Such an arrangement facilitates container nesting.

Figure 12C:
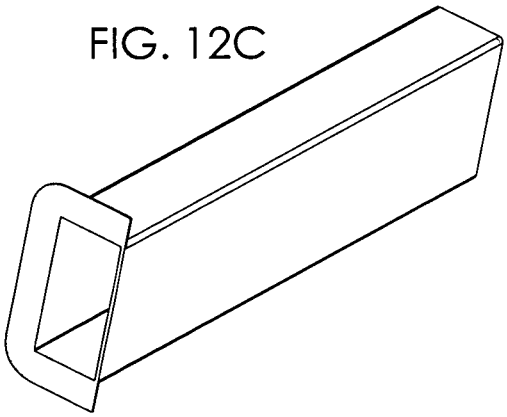
FIG. 12C shows a perspective view of a sleeve of an embodiment of the invention.

In an embodiment of the invention, the elongated sleeve 80 may have flared forward and/or rearward openings (see FIG. 12C which shows a fully tubular sleeve having a flared forward opening). The term "flared" indicates that the forward and/or rearward openings of the elongate sleeve are at least partially surrounded by a perpendicularly extending flattened area of the elongate sleeve (i.e. a flanged area). Without wishing to be bound by theory "flaring" the forward and/or rearward openings of the elongated sleeve will protect the plastic areas surrounding the forward and rearward openings of the elongate channel (e.g. in the container front and back wall respectively) against damage during engagement of a lift member with the elongated channel and elongated sleeve. Preferably, the sleeve is flared upwardly, inwardly and downwardly, but not outwardly, so as not to prevent facile nesting of a plurality of containers (see FIG. 12C for reference).

In an embodiment of the invention, cushioning material may be utilized between the sleeve and the walls of the elongated channel to reduce the impact of a lifting member on the elongated channel walls and the container body during lifting of the container. The cushioning material may be a bushing between the sleeve and the walls of the elongated channel, and may be made from any suitable material such as for example plastic or rubber materials. The cushioning material can also be in the form of a gasket between the sleeves and points of contact with the plastic walls of the elongated channels.

Figure 13A:
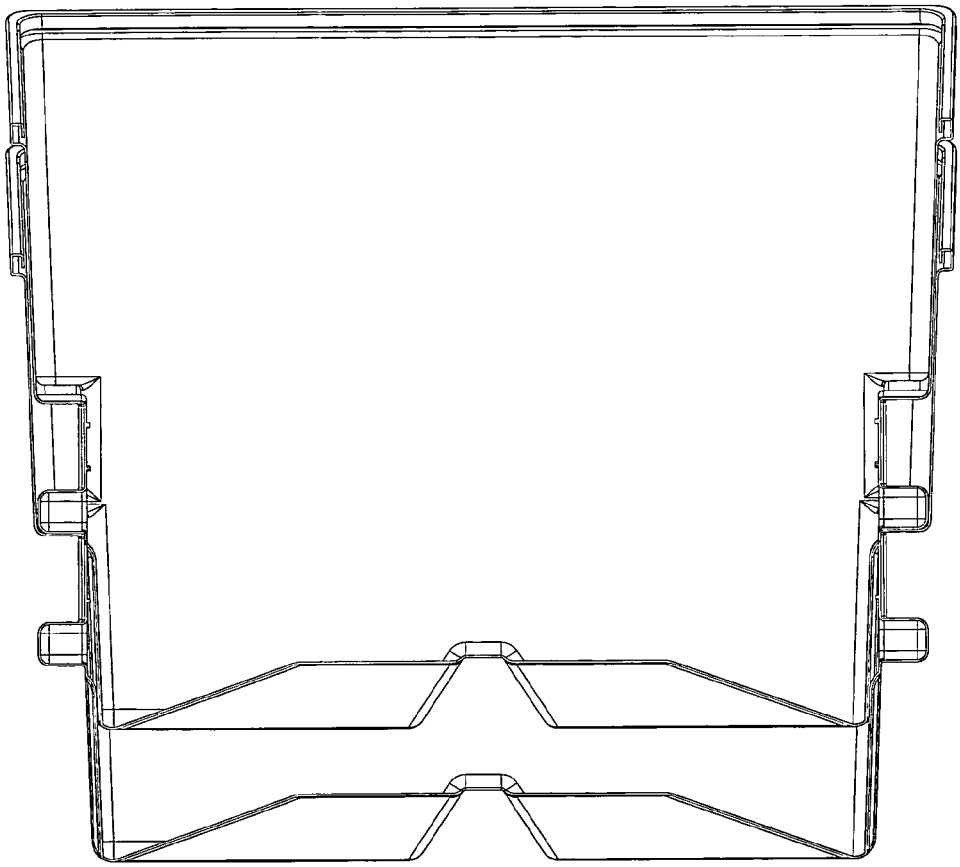
FIG. 13A shows a front cross sectional view of nested containers of an embodiment of the invention. The cross section is taken along a line bisecting the side walls of the nested containers.
Figure 13B:
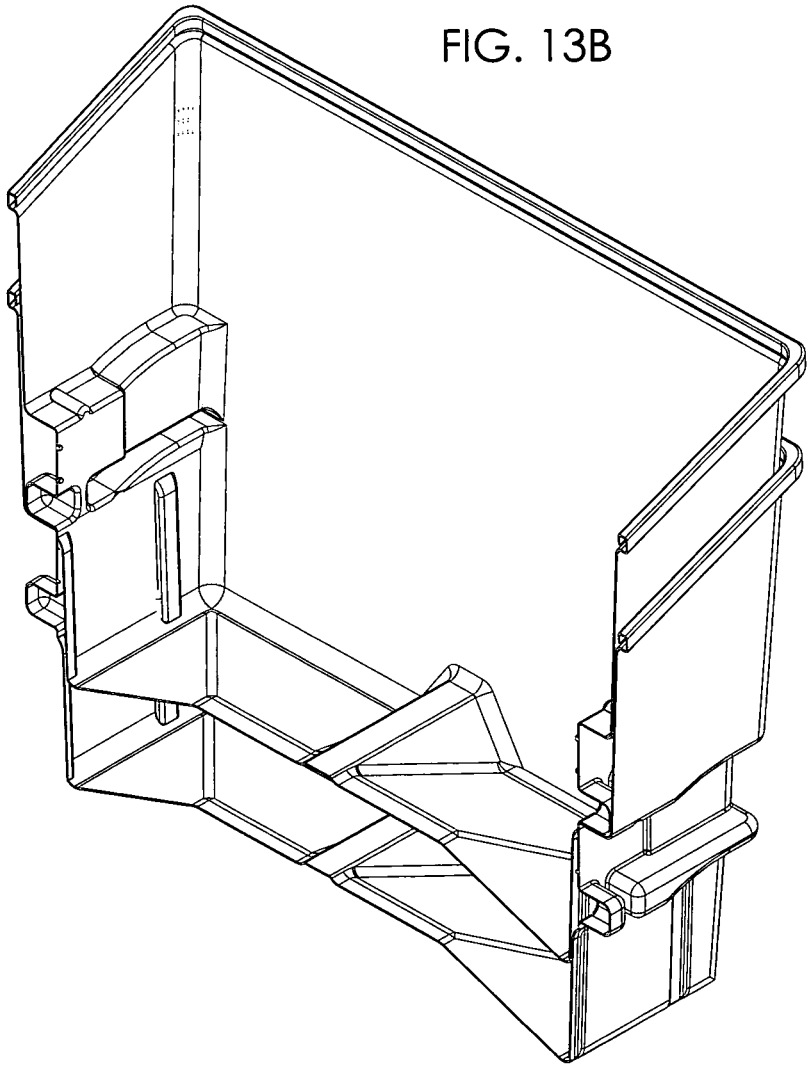
FIG. 13B shows a perspective cross sectional view of nested containers of an embodiment of the invention. The cross section is taken along a line bisecting the side walls of the nested containers.
Figure 14:
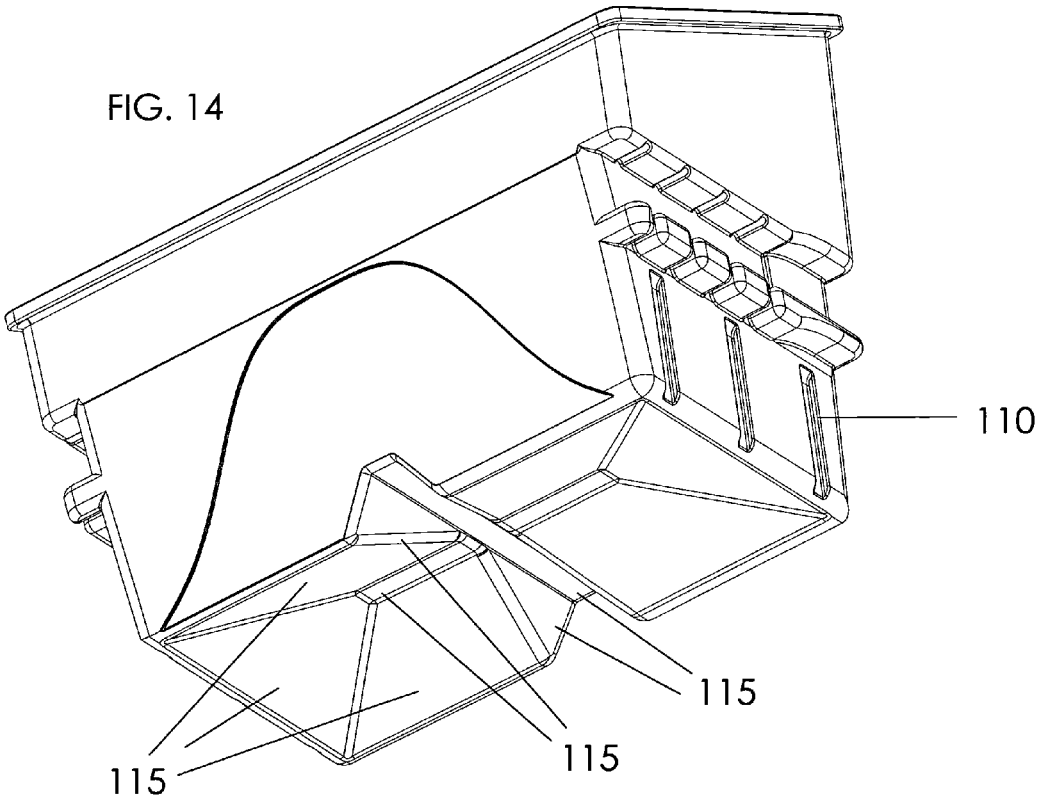
FIG. 14 shows a lower perspective view of an embodiment of the current invention.
Figure 15:
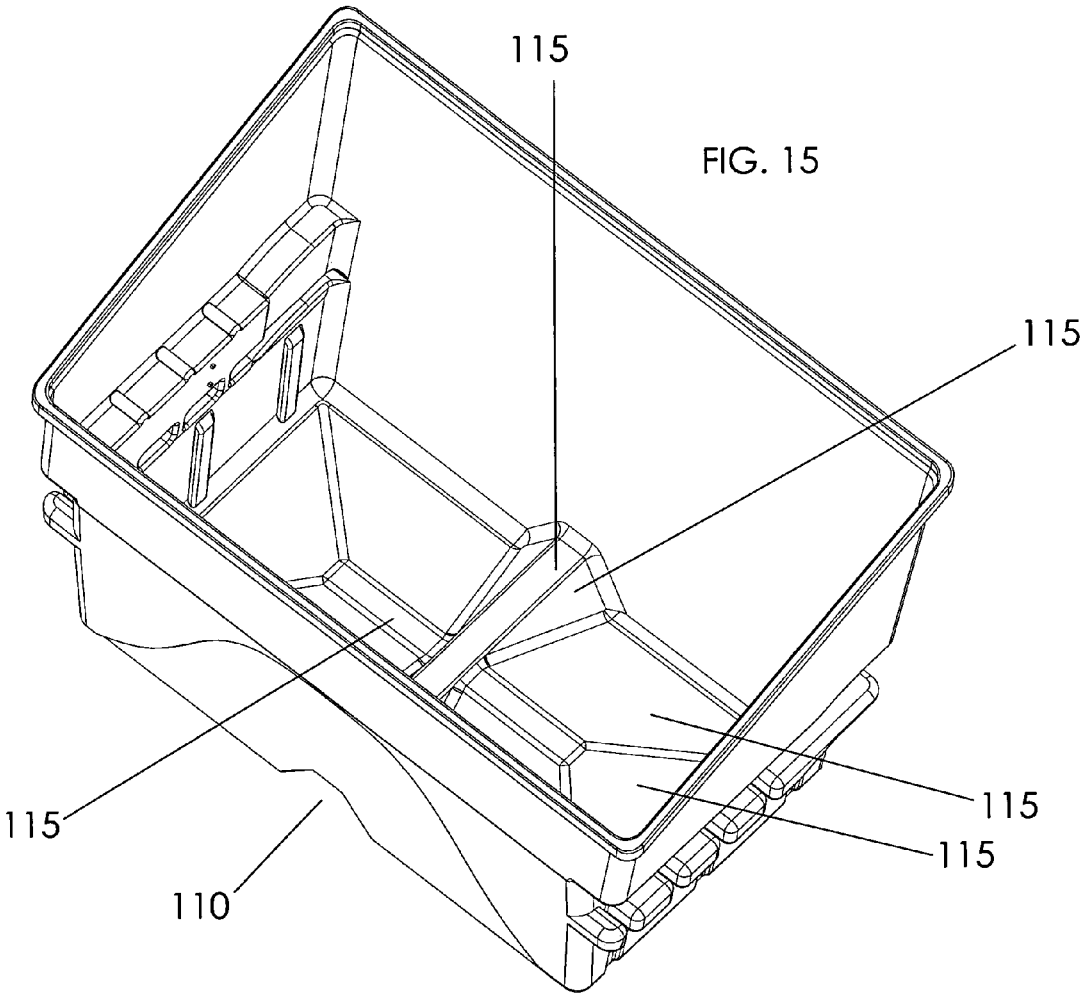
FIG. 15 shows an upper perspective view of an embodiment of the current invention.

In an embodiment of the present invention, the upper shelf surface 67 defined by said upper outwardly extending sidewall portion and the lower shoulder surface 73 defined by said lower outwardly extending sidewall portion are complementary surfaces which can easily abut one another in a plurality of stacked or nested containers. FIGS. 13A and 13B show how the upper shelf surfaces of a lower container abut the lower shoulder surfaces of an upper container in a nested container configuration.

In an embodiment of the invention, and with reference to FIG. 5A (also see FIG. 2), the lower outwardly extending side wall portion 55 (or 55') in each side wall has a plurality of vertical grooves 85 (or 85') which are spaced laterally relative to one another. The vertical grooves may penetrate the entire outwardly extending distance of the lower outwardly extending sidewall portion so as to divide the lower outwardly extending sidewall portion into a plurality of outwardly extending islands 90 (or 90') which are laterally spaced relative to one another.

In an embodiment of the invention, an upper shelf surface 67 and a lower shoulder surface 73 further comprise complimentary contoured shapes which engage one another in a plurality of (nested) stacked containers. For example, the upper shelf surface may have an upwardly contoured arcuate shape in a rearward region of the upper shelf, while the lower shoulder surface may have a complementary arcuate cut out in a rearward region, as shown in FIGS. 4 and 5A (as well as FIGS. 1 and 2). With reference to FIG. 5A, the contoured area of the lower outwardly extending sidewall portion may be present in a lower shoulder surface of one of more outwardly extending islands 90. FIG. 13B shows how the contoured surfaces engage one another in a nested container configuration.

Figure 8:
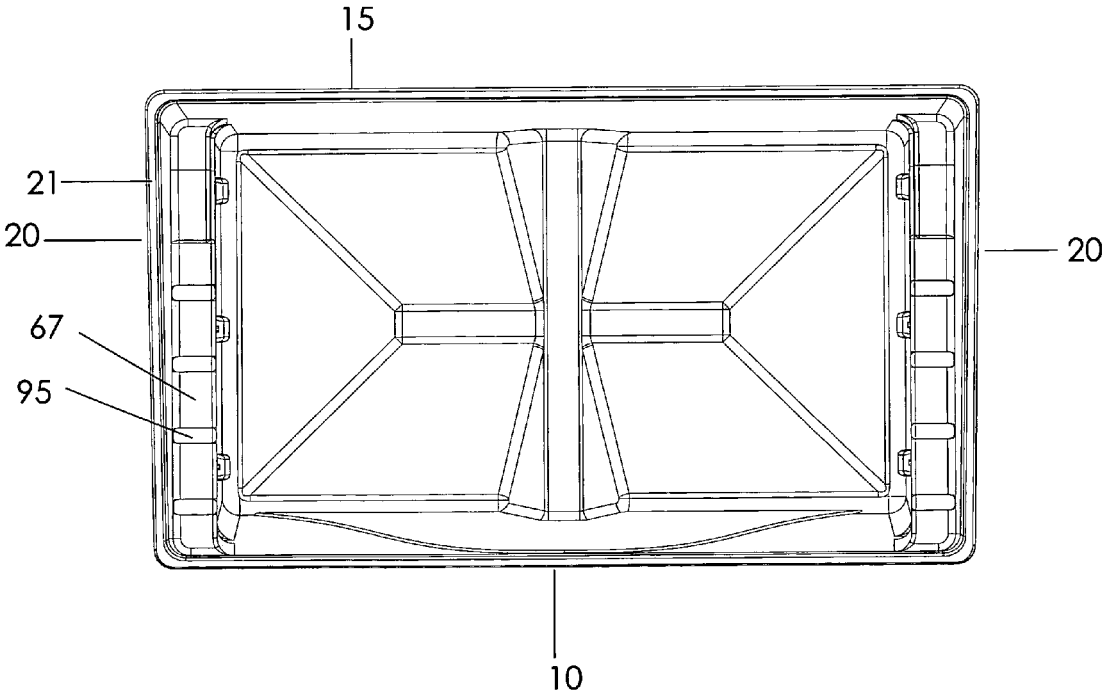
FIG. 8 shows a top plan view of an embodiment of the invention.
Figure 9:
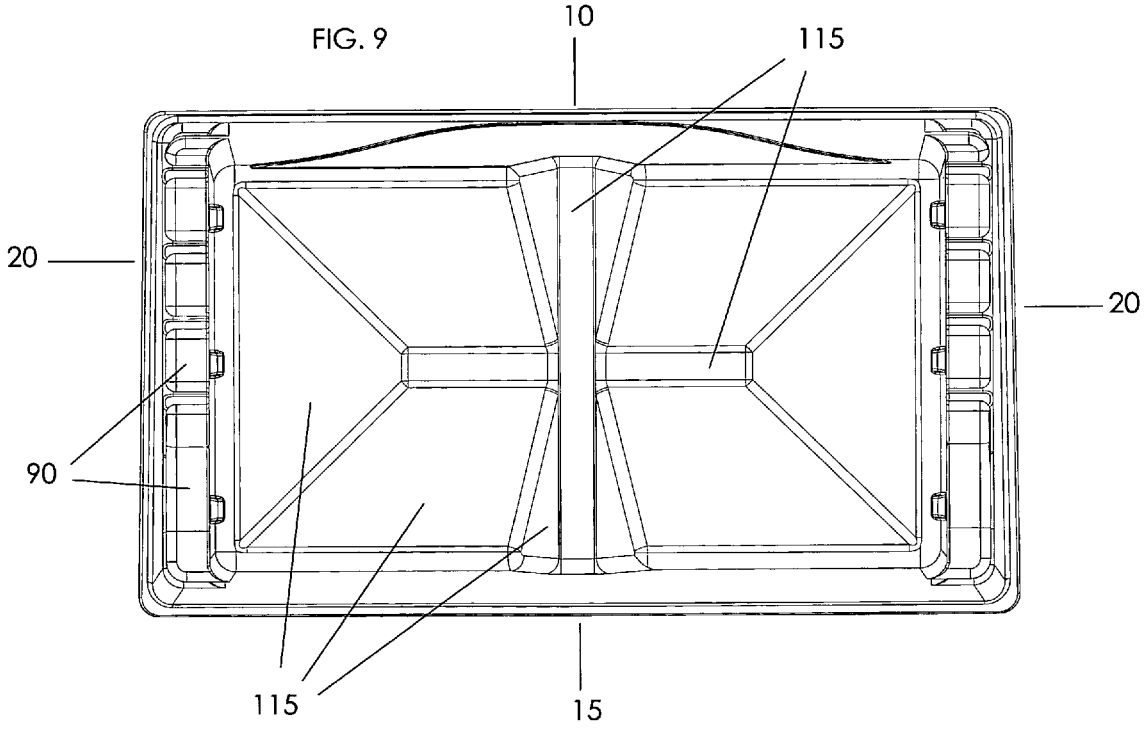
FIG. 9 shows a bottom plan view of an embodiment of the invention.

In another embodiment, the upper shelf surface 67 (or 67') has a plurality of knobs 95 (or 95') which are complementary to vertical grooves 85 (or 85') present in the lower outwardly extending sidewall portion, so that the knobs can engage the grooves in a plurality of (nested) stacked containers. In another embodiment, the knobs 95 (or 95') may engage the spaces between a plurality of outwardly extending islands 90 (or 90'). The knobs can be of any suitable shape capable of engaging the grooves or spaces between outwardly extending islands. For example the knobs may be one or more bumps which span the depth of the upper shelf surface as shown in FIGS. 1, 4 and 8.

Figure 6C:
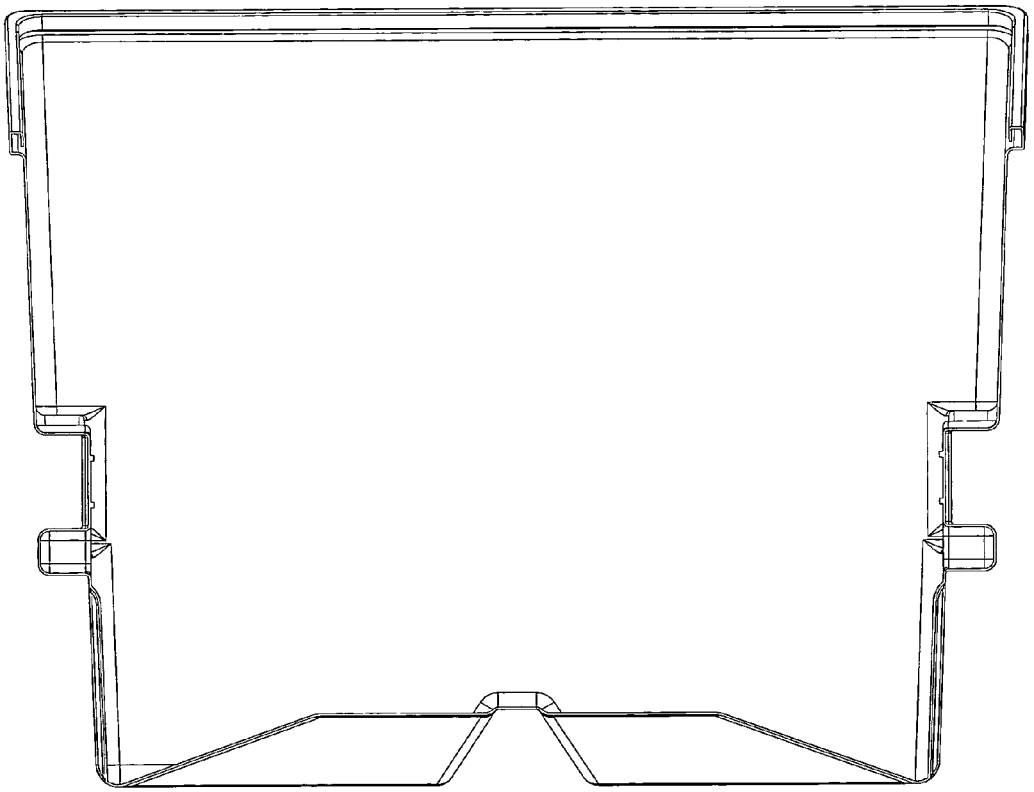
FIG. 6C shows a front cross-sectional view taken along a line bisecting the side walls of a container in an embodiment of the invention.
Figure 7:
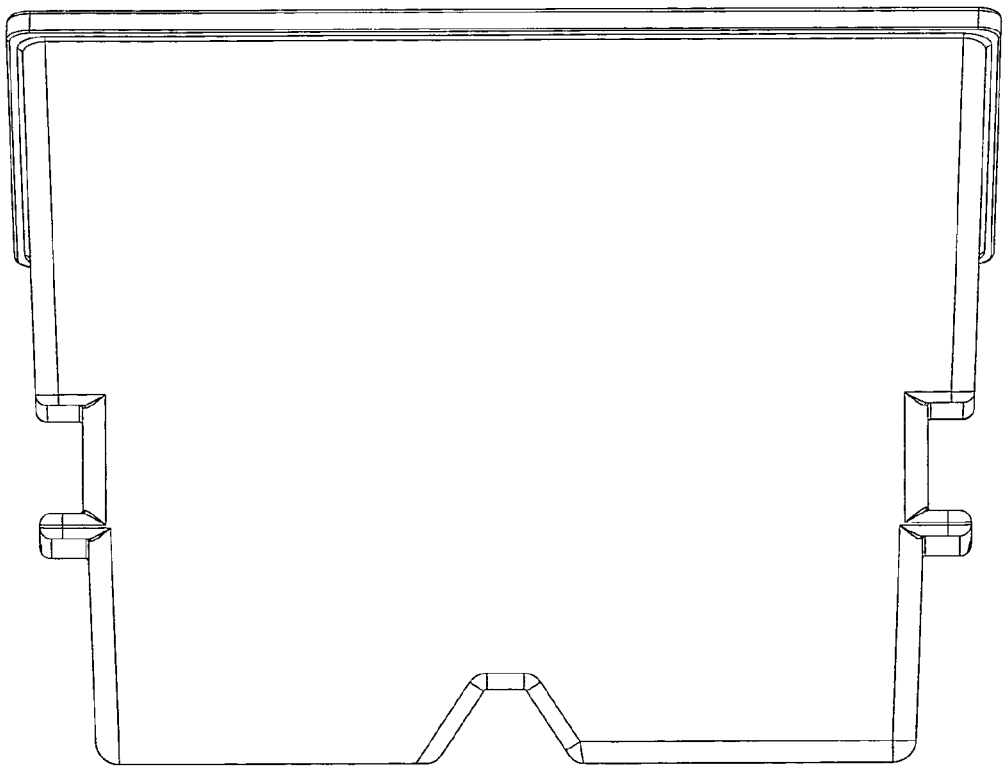
FIG. 7 shows a rear view of an embodiment of the invention.

For container nesting purposes it may be preferable for at least a portion of at least one of the container front and back wall to be outwardly leaning. By "outwardly leaning" it is meant that a wall or wall portion is not perpendicular with the base or surface on which the base rests, but instead leans outwardly (relative to the container interior) when moving vertically away from the container base and toward the container open top. With reference to FIGS. 4 and 5A, a lower portion 100 of the container front wall is outwardly leaning and the entirety of the container back wall is outwardly leaning. For container nesting purposes is may also be preferable that portions of the container side walls be outwardly leaning. With reference to FIGS. 6A, 6C and 7 the upper outwardly extending sidewall portion in each side wall is an outwardly leaning sidewall portion and the lower recessed sidewall portion in each side wall is an outwardly leaning sidewall portion.

In an embodiment of the invention, a portion of the container front, back and side walls is outwardly leaning.

In an embodiment of the invention, a lower portion 100 of the container front wall is outwardly leaning and the entirety of the container back wall is outwardly leaning.

In an embodiment of the invention, the lower recessed sidewall portions 75 are outwardly leaning. In an embodiment of the invention, the upper outwardly extending sidewall portions 50 are outwardly leaning.

In an embodiment of the invention, the upper outwardly extending sidewall portions 50 and the lower recessed sidewall portions 75 are outwardly leaning.

In an embodiment of the invention, a lower portion 100 of the container front wall is outwardly leaning, the entirety of the container back wall 15 is outwardly leaning, each of the upper outwardly extending sidewall portions 50 is outwardly leaning, and each of the lower recessed portions 75 is outwardly leaning.

The container can have one or more reinforcement ribs 110. Reinforcement ribs are areas of a container base, front wall, back wall, or side wall, which are grooved or indented to provide a rib-like structure, which is resistant to inward or outward flexing under stress. Such rib-like structures can have numerous shapes, sizes and orientations as is well understood by persons skilled in the art. With reference to FIGS. 4, 6A, 9, 14 and 15 the container may have a horizontal reinforcement rib centrally located in the base. Also, with reference to FIGS. 4, 5A and 14 the side walls, particularly the lower recessed side wall portions may have a plurality of vertical reinforcing ribs. Other arrangements and positions for the reinforcing ribs can be chosen by a person skilled in the art, and are fully contemplated by the scope of the present invention.

The container base may have a concave shape or upwardly and inwardly projecting panels of various shape and dimension along with horizontal or flat panels of various shape and dimension to further improve the structural rigidity of the base and/or to improve container nestability. See for example, FIGS. 8, 9, 14 and 15 which show a base which has upwardly angled and horizontal panel components 115 of various dimension and shape and which together form the base 5.

In an embodiment of the invention, the container may have an edge detail or offset detail in one or more of the container front wall, back wall or side walls. With reference to FIG. 4, a curved offset detail 125 is present in the front wall.

The container may be fitted with a lid in some embodiments of the invention. The lid may comprise one or more lid sections. The lid or lid sections can be made of plastic and have single wall construction or double wall construction. The lid or lid sections can be made using any suitable process such injection molding, reaction injection molding, compression molding, sheet thermoforming, rotational molding and blow molding processes.

If present, the lid sections may be pivotally attached to an upper edge of one or more of the container front, back or side walls. In an embodiment of the invention the lid is portioned into two lid sections, and each lid section is pivotally attached to an adjacent area of the upper edge of the back wall (for a useful lid structure see co-pending U.S. patent application Ser. No. 12/657,834). A lid may be pivotally attached using one or more hinge means or a flexible webbing or other hinge means that are well known to persons skilled in the art. If present, preferably the one or more lid sections is pivotally attached to an adjacent area of the upper edge of the back wall with one or more hinges. Hinge components may be integrally molded within a lid structure, typically along a perimeter edge. Hinge components may also be integrally molded proximal to an a upper container edge, on any of the container front, back and side walls, but are preferably integrally molded proximal to an upper edge of the container back wall. Hinges can also be added post molding, including for example, pre-fabricated piano hinges, and the like. If the presence of a lid is desired in combination with a nested container stack of a plurality of containers, it is preferable that only the terminal uppermost container of the container stack have a lid.

In an embodiment of the present invention, the container body is a substantially continuous unitary container body, and is fabricated from a plastic material selected independently from thermoset plastic materials, thermoplastic materials, and combinations thereof. As used herein the terms "substantially continuous unitary container body," "unitary container", "unitary plastic container" and the like, means that all components of a container body (i.e. all those components of the container such as the container base, the container front wall, the container back wall, and the two opposing container side walls etc., but excluding the optional reinforcement sleeves and optional lid) are continuous with each other.

The container body (and optional lid or lid sections) of the present invention may be fabricating from one or more plastic materials selected from thermoset plastics and thermoplastics.

By way of non-limiting example, the container of the present invention may be fabricated from plastics selected from the group comprising thermoplastic polyurethane, thermoplastic polyurea, thermoplastic polyimide, thermoplastic polyamide, thermoplastic polyamideimide, thermoplastic polyester, thermoplastic polycarbonate, thermoplastic polysulfone, thermoplastic polyketone, thermoplastic polyolefins, thermoplastic (meth)acrylates, thermoplastic acrylonitrile-butadiene-styrene, thermoplastic styrene-acrylonitrile, thermoplastic acrylonitrile-stryrene-acrylate.

As used herein and in the claims, the term "polyolefin" and similar terms, such as, "polyalkylene" and "thermoplastic polyolefin", means polyolefin homopolymers, or polyolefin copolymers, including homogeneous polyolefins and/or heterogeneous polyolefins. For purposes of illustration only, examples of polyolefin copolymers include those prepared from ethylene and one or more $C_3$-$C_{12}$ alpha-olefins, such as, 1-butene, 1-hexene and/or 1-octene. Polyolefins include heterogeneous polyolefins, homogeneous polyolefins, or combinations thereof. The term "heterogeneous polyolefin" and similar terms means polyolefins having a relatively wide molecular weight distribution (i.e., a polydispersity index of greater than about 3); and a low comonomer distribution breadth index CDBI (i.e. a CDBI value of less than about 50 percent or less than about 40 percent). Heterogeneous polyolefins can for example by prepared using Ziegler-Natta type or Phillips type catalysts. The term "homogeneous polyolefin" and similar terms means polyolefins having a relatively narrow molecular weight distribution (i.e., a polydispersity index of less than about 3); and a high comonomer distribution breadth index CDBI (i.e. a CDBI value of greater than about 50 percent, or greater than about 60 percent or greater than about 70 percent). Homogeneous polyolefins are typically prepared by use of single-site catalysts such as for example a metallocene catalyst, a constrained-geometry catalyst and catalysts comprising a phosphinimide ligand, all of which are well known to persons skilled in the art.

An example of homogeneous ethylene/alpha-olefin copolymers are SURPASS polyethylenes, commercially available from NOVA Chemicals Inc.

The term "polydispersity index" (PDI) is the ratio of $M_w/M_n$, where $M_w$ means weight average molecular weight, and $M_n$ means number average molecular weight, each being determined by means of gel permeation chromatography (GPC) using appropriate standards.

The comonomer distribution breadth index (CDBI) values, is the weight percent of polymer molecules having a comonomer content within 50 percent of the median total molar comonomer content. Composition distribution breadth index values may be determined by art recognized methods, for example, temperature rising elution fractionation (TREF), as described by Wild et al, Journal of Polymer Science, Poly. Phys. Ed., Vol. 20, p. 441 (1982), or in U.S. Pat. No. 4,798,081 or in U.S. Pat. No. 5,089,321.

As used herein the term "thermoset plastic material" and similar terms, such as, "thermosetting or thermosetable plastic materials" means plastic materials having, or that form, a three dimensional crosslinked network resulting from the formation of covalent bonds between chemically reactive groups, e.g., active hydrogen groups and free isocyanate groups, or between unsaturated groups. Thermoset plastic materials from which the container and various components thereof may each be independently fabricated include those known to persons skilled in the art, e.g., crosslinked polyurethanes, crosslinked polyepoxides, crosslinked polyesters (such as, sheet molding compound compositions) and crosslinked polyunsaturated polymers. The use of thermosetting plastic materials typically involves the art-recognized process of reaction injection molding. Reaction injection molding typically involves, as is known to the skilled artisan, injecting separately, and preferably simultaneously, into a mold, for example: (i) an active hydrogen functional component (e.g., a polyol and/or polyamine); and (ii) an isocyanate functional component (e.g., a diisocyanate such as, toluene diisocyanate, and/or dimers and trimers of a diisocyanate such as toluene diisocyanate). The filled mold may optionally be heated to ensure and/or hasten complete reaction of the injected components.

In an embodiment of the present invention, the thermoplastic material from which the container is fabricated is a thermoplastic polyolefin.

The plastic materials from which the container may be fabricated, may, in each case, independently and optionally include a reinforcing material selected, for example, from glass fibers, glass beads, carbon fibers, metal flakes, metal fibers, polyamide fibers (e.g., KEVLAR polyamide fibers), cellulosic fibers, nanoparticulate clays, talc and mixtures thereof. If present, the reinforcing material is typically present in a reinforcing amount, e.g., in an amount of from 5 percent by weight to 60 or 70 percent by weight, based on the total weight of the component (i.e., the sum of the weight of the plastic material and the reinforcing material). The reinforcing fibers, and the glass fibers in particular, may have sizings on their surfaces to improve miscibility and/or adhesion to the plastic materials into which they are incorporated, as is known to persons skilled in the art.

In addition or alternatively to reinforcing material(s), the plastic materials from which the container may be fabricated, may in each case independently and optionally further include one or more additives. Additives that may be present in the plastic materials include, but are not limited to, antioxidants, colorants, e.g., pigments and/or dyes, mold release agents, fillers, e.g., calcium carbonate, ultraviolet light absorbers, fire retardants and mixtures thereof. Additives may be present in the plastic material of each plastic component in functionally sufficient amounts, e.g., in amounts independently from 0.1 percent by weight to 10 percent by weight, based on the total weight of the particular plastic component.

The plastic components of the container of the present invention may be prepared by art-recognized methods, including, but not limited to, injection molding, reaction injection molding, compression molding, sheet thermoforming, rotational molding and blow molding.

In an embodiment of the invention, the container is made using a rotational molding process.

The container of the present invention, and the various components thereof, may have any suitable dimensions or capacity, provided that they are suitable (e.g. not too large or too small) for the materials employed for its construction. By way of non-limiting example only, the volumetric capacity is of the container can be between 1 and 10 cubic yards. Over-all widths, heights and depths can be highly varied, but in an embodiment of the invention, the width of a container is generally not much more than about 80" in order to accommodate standard lift trucks, and folk lift devices.

In an embodiment of the invention, the container is a waste container.

What is claimed is:

1. A container comprising:

a) a unitary plastic container body comprising a container base, a container front wall, a container back wall, and two opposing container side walls, each container wall extending upwardly from said container base to define an open container top and an interior container volume, each container side wall comprising:

an upper outwardly extending sidewall portion, a lower outwardly extending sidewall portion, an upper recessed sidewall portion residing between said upper and lower outwardly extending sidewall portions, and a lower recessed sidewall portion residing below said lower outwardly extending sidewall portion;

said upper outwardly extending sidewall portion, said upper recessed sidewall portion, and said lower outwardly extending sidewall portion together defining there-between an elongated channel having a forward opening, a rearward opening and an elongated side opening extending from said forward opening to said rearward opening;

said upper outwardly extending sidewall portion comprising an upper shelf surface residing within said container interior;

said lower outwardly extending sidewall portion comprising a lower shoulder surface; wherein said upper shelf surface and said lower shoulder surface are complementary surfaces so that said upper shelf surface of a lower one of said containers can abut against the lower shoulder surface of an upper one of said containers, thereby facilitating the stacking of a plurality of said containers; and b) a pair of open ended elongated sleeves, each sleeve fixed within a corresponding elongated channel in each of said container side walls.

2. The container of claim 1 wherein said open ended elongated sleeves are tubular.

3. The container of claim 2 wherein said open ended elongated sleeves are fabricated from a material selected from the group consisting of metals, thermoset plastic materials, and thermoplastic materials.

4. The container of claim 2 wherein said open ended elongated sleeves are fabricated from at least one metal.

5. The container of claim 1 wherein the vertical dimension of said container back wall is larger than the vertical dimension of said container front wall so that each of said container side walls has an upper edge which angles upwardly from said container front wall to said container back wall.

6. The container of claim 1 wherein, in each container side wall, said upper outwardly extending sidewall portion has an outward extending distance relative to said lower recessed sidewall portion, said lower outwardly extending sidewall portion has an outward extending distance relative to said lower recessed sidewall portion, said outward extending distance of said upper outwardly extending sidewall portion and said outward extending distance of said lower outwardly extending sidewall portion being substantially equivalent.

7. The container of claim 1 further comprising a lid.

8. The container of claim 1 wherein said lower outwardly extending sidewall portion in each container side wall comprises a plurality of vertical grooves that are laterally spaced relative to one another.

9. The container of claim 8 wherein said vertical grooves divide said lower outwardly extending sidewall portion into a plurality of outwardly extending islands which are laterally spaced relative to one another.

10. The container of claim 1 wherein at least one reinforcement rib is present in at least one of the container base, front wall, back wall, or side walls.

11. The container of claim 1 wherein said container body is fabricated from a plastic material selected from the group consisting of thermoset plastic materials, thermoplastic materials and combinations thereof.

12. A container comprising:

a) a plastic container body comprising a container base, a container front wall, a container back wall, and two opposing container side walls, each container wall extending upwardly from said container base to define an open container top and an interior container volume, each container side wall comprising:

an upper outwardly extending sidewall portion, a lower outwardly extending sidewall portion, an upper recessed sidewall portion residing between said upper and lower outwardly extending sidewall portions, and a lower recessed sidewall portion residing below said lower outwardly extending sidewall portion;

said upper outwardly extending sidewall portion, said upper recessed sidewall portion, and said lower outwardly extending sidewall portion together defining there-between an elongated channel having a forward opening along said container front wall, a rearward opening along said container back wall, and an elongated side opening extending from said forward opening to said rearward opening;

said upper outwardly extending sidewall portion comprising an upper shelf surface residing within said container interior;

said lower outwardly extending sidewall portion comprising a lower shoulder surface; wherein said upper shelf surface and said lower shoulder surface are complementary surfaces so that said upper shelf surface of a lower one of said containers can abut against the lower shoulder surface of an upper one of said containers, thereby facilitating the stacking of a plurality of said containers; and b) a pair of open ended elongated sleeves, each sleeve fixed within a corresponding elongated channel in each of said container side walls.

13. The container of claim 12 wherein a lower portion of said container front wall is outwardly leaning and said container back wall is outwardly leaning, thereby facilitating the nesting of a plurality of said containers.

14. The container of claim 13 wherein, said lower recessed sidewall portion in each container side wall is outwardly leaning, thereby facilitating the nesting of a plurality of said containers.

15. The container of claim 14 wherein, in each container side wall, said upper outwardly extending sidewall portion has an outward extending distance relative to said lower recessed sidewall portion, said lower outwardly extending sidewall portion has an outward extending distance relative to said lower recessed sidewall portion, said outward extending distance of said upper outwardly extending sidewall portion and said outward extending distance of said lower outwardly extending sidewall portion being substantially equivalent.

16. The container of claim 12 wherein at least a portion of said upper shelf surface and at least a portion of said lower shoulder surface are complementary contoured surfaces so that the contoured surface of said upper shelf of a lower one of said containers can engage the contoured surface on said lower shoulder of an upper one of said containers, thereby facilitating the stacking of a plurality of said containers.

17. The container of 12 wherein said lower outwardly extending sidewall portion in each container side wall further comprises a plurality of vertical grooves that are laterally spaced relative to one another.

18. The container of claim 17 wherein said vertical grooves divide said lower outwardly extending sidewall portion into a plurality of outwardly extending islands which are laterally spaced relative to one another.

19. The container of claim 17 wherein said upper shelf surface has a plurality of knobs which are complementary to the vertical grooves in said lower outwardly extending sidewall portion so that the knobs on said upper shelf surface of a lower one of said containers can engage the grooves in said outwardly extending sidewall portion of an upper one of said containers, thereby facilitating the stacking of a plurality of said containers.

20. A container comprising:

a) a plastic container body comprising a container base, a container front wall, a container back wall, and two opposing container side walls, each container wall extending upwardly from said container base to define an open container top and an interior container volume, each container side wall comprising:

an upper outwardly extending sidewall portion, a lower outwardly extending sidewall portion, an upper recessed sidewall portion residing between said upper and lower outwardly extending sidewall portions, and a lower recessed sidewall portion residing below said lower outwardly extending sidewall portion;

said upper outwardly extending sidewall portion, said upper recessed sidewall portion, and said lower outwardly extending sidewall portion together defining there-between an elongated channel having a forward opening along said container front wall, a rearward opening along said container back wall, and an elongated side opening extending from said forward opening to said rearward opening;

said upper outwardly extending sidewall portion comprising an upper shelf surface residing within said container interior;

said lower outwardly extending sidewall portion comprising a lower shoulder surface; and b) a pair of open ended elongated sleeves, each sleeve fixed within a corresponding elongated channel in each of said container side walls;

wherein a lower portion of said container front wall is outwardly leaning, said container back wall is outwardly leaning, and said lower recessed sidewall portion in each container side wall is outwardly leaning, thereby facilitating the nesting of a plurality of said containers;

said upper shelf surface and said lower shoulder surface are complementary surfaces so that the said upper shelf surface of a lower one of said containers can abut against the lower shoulder surface of an upper one of said containers, thereby facilitating the stacking of a plurality of said containers;

and in each container side wall, said upper outwardly extending sidewall portion has an outward extending distance relative to said lower recessed sidewall portion, said lower outwardly extending sidewall portion has an outward extending distance relative to said lower recessed sidewall portion, said outward extending distance of said upper outwardly extending sidewall portion and said outward extending distance of said lower outwardly extending sidewall portion being substantially equivalent.

21. A nested container stack comprising a plurality of containers defined as in claim 12, 13, 14, 15, 20, 16, 17, 18 or 19, wherein the base of an upper container is received through the open top of a lower container so that a portion of said upper container is received within the interior volume of said lower container.

22. A container comprising:

a) a plastic container body comprising a container base, a container front wall, a container back wall, and two opposing container side walls, each container wall extending upwardly from said container base to define an open container top and an interior container volume, each container side wall comprising:

an upper outwardly extending sidewall portion, a lower outwardly extending sidewall portion, an upper recessed sidewall portion residing between said upper and lower outwardly extending sidewall portions, and a lower recessed sidewall portion residing below said lower outwardly extending sidewall portion;

said upper outwardly extending sidewall portion, said upper recessed sidewall portion, and said lower outwardly extending sidewall portion together defining there-between an elongated channel having a forward opening along said container front wall, a rearward opening along said container back wall, and an elongated side opening extending from said forward opening to said rearward opening;

said upper outwardly extending sidewall portion comprising an upper shelf surface residing within said container interior;

said lower outwardly extending sidewall portion comprising a lower shoulder surface; and b) a pair of open ended elongated sleeves, each sleeve fixed within a corresponding elongated channel in each of said container side walls;

wherein a lower portion of said container front wall is outwardly leaning, said container back wall is outwardly leaning and said lower recessed sidewall portion in each container side wall is outwardly leaning, thereby facilitating the nesting of a plurality of said containers;

at least a portion of said upper shelf surface and at least a portion of said lower shoulder surface are complementary contoured surfaces so that the contoured surface of said upper shelf of a lower one of said containers can engage the contoured surface on said lower shoulder of an upper one of said containers, thereby facilitating the stacking of a plurality of said containers;

and in each container side wall, said upper outwardly extending sidewall portion has an outward extending distance relative to said lower recessed sidewall portion, said lower outwardly extending sidewall portion has an outward extending distance relative to said lower recessed sidewall portion, said outward extending distance of said upper outwardly extending sidewall portion and said outward extending distance of said lower outwardly extending sidewall portion being substantially equivalent.

23. A container comprising:

a) a plastic container body comprising a container base, a container front wall, a container back wall, and two opposing container side walls, each container wall extending upwardly from said container base to define an open container top and an interior container volume, each container side wall comprising:

an upper outwardly extending sidewall portion, a lower outwardly extending sidewall portion, an upper recessed sidewall portion residing between said upper and lower outwardly extending sidewall portions, and a lower recessed sidewall portion residing below said lower outwardly extending sidewall portion;

said upper outwardly extending sidewall portion, said upper recessed sidewall portion, and said lower outwardly extending sidewall portion together defining there-between an elongated channel having a forward opening along said container front wall, a rearward opening along said container back wall, and an elongated side opening extending from said forward opening to said rearward opening;

said upper outwardly extending sidewall portion comprising an upper shelf surface residing within said container interior;

said lower outwardly extending sidewall portion comprising a lower shoulder surface;

wherein said upper shelf surface has a plurality of knobs which are complementary to laterally spaced vertical grooves present in said lower outwardly extending sidewall portion so that the knobs on said upper shelf surface of a lower one of said containers can engage the grooves in said lower outwardly extending sidewall portion of an upper one of said containers, thereby facilitating the stacking of a plurality of said containers; and b) a pair of open ended elongated sleeves, each sleeve fixed within a corresponding elongated channel in each of said container side walls;

wherein a lower portion of said container front wall is outwardly leaning, said container back wall is outwardly leaning, and said lower recessed sidewall portion in each container side wall is outwardly leaning, thereby facilitating the nesting of a plurality of said containers.

24. A nested container stack comprising a plurality of containers defined as in claim 22 or 23, wherein the base of an upper container is received through the open top of a lower container so that a portion of said upper container is received within the interior volume of said lower container.

* * * * *

UNITED STATES PATENT AND TRADEMARK OFFICE

CERTIFICATE OF CORRECTION

PATENT NO. : 8,631,940 B2
APPLICATION NO. : 12/807487
DATED : January 21, 2014
INVENTOR(S) : Henry F. Hay, Daniel Andrew Depenhart and Sean Barton It is certified that error appears in the above-identified patent and that said Letters Patent is hereby corrected as shown below:

On the title page, item (73), make the correction as follows:

Delete: "(73) Assignee: Nova Chemical (International). SA,
Fribourg (CH);" and insert the following:

--(73) Assignee: NOVA Chemicals (International) S.A.
Fribourg (CH)--

Signed and Sealed this
Seventh Day of April, 2015

Michelle K. Lee

Michelle K. Lee
*Director of the United States Patent and Trademark Office*